US005201396A

United States Patent [19]

Chalabian et al.

[11] Patent Number: 5,201,396

[45] Date of Patent: Apr. 13, 1993

[54] ELECTRONIC COIN MECHANISM AND SYSTEM

[75] Inventors: Jack S. Chalabian, Huntington Beach; Dennis M. Kaloi; Richard A. Simon, both of Agoura; Arden R. Thompson, Murrieta; Craig A. DeWeese, Anaheim, all of Calif.

[73] Assignee: K-Jack Engineering Company, Inc., Gardena, Calif.

[21] Appl. No.: 800,544

[22] Filed: Nov. 27, 1991

[51] Int. Cl.[5] ..... G07D 5/02; G07F 11/02

[52] U.S. Cl. ..... 194/217; 194/336

[58] Field of Search ..... 194/216, 217, 218, 334, 194/336

[56] References Cited

U.S. PATENT DOCUMENTS

| | | | |
|---|---|---|---|
| 2,594,422 | 4/1952 | Gordon | 194/334 X |
| 3,371,761 | 3/1968 | Hirano | 194/334 X |
| 3,939,954 | 2/1976 | Collins | 194/334 X |
| 4,845,484 | 7/1989 | Ellsberg | 221/154 X |

*Primary Examiner*—F. J. Bartuska
*Attorney, Agent, or Firm*—Beehler & Pavitt

[57] ABSTRACT

An improved electronic coin mechanism and coin operated dispensing system includes an electronic coin mechanism which controls operation of a vending machine and stores certain types of data. The data in raw form are read out by a reader which may be interfaced to a computer through a shuttle. Due to the variety of information which may be collected, the computer is able to generate a variety of reports. The electronic coin mechanism is battery operated and designed for long service life. The mechanism includes an apertured rotatable coin wheel which detects the value of a coin by its diameter and compared the count with stored information in the coin electronics, the latter having an elapsed time relative counter. Time of first and last sale as well as sales per period are stored as well as total amounts received. Various levels of security are provided. Details of the coin mechanism and system are described.

31 Claims, 20 Drawing Sheets

TO PREVENT UNWANTED SPURIOUS PULSES WHICH YIELD ERRONEOUS COUNTS, LOG COUNT UPON DETECTION OF THE FALLING EDGE OF COIN SWITCH AT TIME Tc.

COIN RECOGNITION AND SALES ROUTINE

COIN SENSE/TIMING ROUTINE (EXPANDED FLOW)

ELECTRONIC COIN MECHANISM AND SYSTEM

FIELD OF INVENTION

This invention relates to an electronic coin mechanism and data system and more particularly to an improved electronic coin mechanism and system that performs multiple functions and cooperates with a reader and computer system to provide a comprehensive data analysis related, for example, to amount of money received by the coin mechanism, the amount of money collected, and other types of relevant and desirable information which can be used for a variety of purposes.

BACKGROUND OF THE INVENTION

Coin operated equipment is well known and of several different varieties. Coin operated telephones, laundry washers and dryers, soda pop vending machines, vending machines in which articles of various prices are dispensed, parking meters, and newspaper vending machines, for example. Each of these types of coin operated machines normally includes a coin mechanism for receiving coins and, in some instances, for totalling the deposited coins. In most instances, vending of the product or enabling use of the device requires that a correct combination of coins of a given value be deposited. Typically the coins are nickels, dimes, quarters, half dollars and dollar coins. Some machines have a paper dollar reader and some even provide change if the amount deposited is greater than the price for the product.

In some instances, coin operated machines are electrically powered by a standard 110 volt power source, e.g., soda pop vending machines which also require refrigeration cooling, laundry washing and drying machines, and convenience vending machines for candy and other miscellaneous items. Other types of vending machines typically are not externally electrically powered and rely on mechanical systems for receiving the coins and, if the proper combination of the required coins are deposited, to dispense or permit access to the article. These latter machines are, for example, newspaper vending machines which are normally placed outdoors and which are exposed to extremes of weather and temperature. Typical such machines are those described in U.S. Pat. Nos. 3,884,330; 4,062,435; 4,049,106; 4,576,271; 4,067,477; 4,183,426; 4,243,134; 4,465,207; 4,227,604; 4,718,532; 4,844,567; assigned to the same assignee and whose disclosures are incorporated herein by reference.

Another difference in coin operated equipment relates to whether the purchaser automatically receives the goods or services automatically upon deposit of the correct purchase amount as contrasted to those instances in which the coin operated dispenser enables access to the product by the purchaser, i.e. opening a door to obtain access to the product. In either instance, however, it is advantageous to provide a coin operated mechanism which permits a variety of coin combinations to be used, rather than a limited number of types of coins, e.g., only quarters, or only dimes and quarters. In these and other types of coin operated equipment, the amounts deposited in the machine are normally collected from time to time. In the case of parking meters and telephone equipment, the coin box may be removed and an empty coin box inserted. This coin box replacement is intended to reduce losses as a result of theft by the collector. Yet, other types of coin operated dispensers are such that the collector merely takes or empties the coins from the machine "bank", without counting them. In this case, the possibility of losses due to thefts is a problem.

In the case of newspaper vending machines or machines which require periodic replacement of the dispensed product, there is both periodic collection of money from the "bank" and re-supply of the machine. In either case, there are advantages to being able to (1) provide a versatile mechanism which permits use of various coin combinations, (2) track the number of dispensable items loaded, (3) count the total value of coins accepted by the machine, (4) count the number of times the unit was used by the deposit of the proper purchase price and thus the number of units sold or provided, (5) record the period of usage, (6) change prices as may be needed, and (7) provide different alternate prices for the product, i.e., daily or Sunday prices as is the case in newspaper vending equipment, (8) provide equipment which is reliably battery operated for relatively long periods in an outdoor environment, (9) provide equipment which is secure in the sense that only those with proper access codes can access the equipment, (10) provide information which may be used to generate meaningful data related to the volume of sales made by the equipment, and the like, for management control purposes.

There are a number of prior art systems which are supposedly electronic coin mechanism and data systems. One such system is that of U.S. Pat. No. 4,845,484, issued on Jul. 4, 1989, assigned to Bellatrix Systems, Inc. and which purports to provide some of the features previously described. However, the Bellatrix system is limited to coins of specified denominations, such as nickels, dimes and quarters. The coin mechanism thus lacks versatility to accommodate the various American coinage in use. Further, the coin mechanism is not self-clearing and may be jammed by foreign objects. The electronic mechanism is powered by lithium thionyl chloride batteries which are classified by the Department of Transportation as hazardous materials. Alkaline batteries are unable to perform in hot/cold climates. The operating temperature range is between 0 degrees and 140 degrees F. Service life of the alkaline batteries is about 1.5 years. If the battery looses power or is replaced in the field, all the stored data is lost. Changes in price are controlled by an external wand and are limited to minimum increments of 5 cents. Further, this mechanism records the time the first article is sold and sales in each of 12 programmable time slots.

Other systems described in U.S. patents are: U.S. Pat. No. 4,216,461 issued to Werth et al, U.S. Pat. No. 4,306,219 issued to Main et al and U.S. Pat. No. 4,369,442 issued to Werth et al. However, the systems of these patents are dispensing systems other than newsracks, the latter presenting unique problems, not the least of which is the necessity to use battery power and long service life over a wide variety of climate conditions. Moreover, in the case of newsracks, the number of papers dispensed is not normally counted as such since the nature of the usual rack is such than upon deposit of the proper amount, the rack door is permitted to be opened and the purchaser may take one or more copies of the paper. The exception is those racks which permit only a single copy to be taken. Normally, the count of papers sold is the difference between the number loaded into the machine and the number retrieved.

Another problem with the systems of the prior art described is that only summary data may be extracted from the electronics. This not only complicates the machine electronics but significantly limits the useful information which may be extracted. It is much more preferable for management control and reporting to extract all or a defined amount of the raw data stored in the machine electronics and to use a separate computer to manipulate the data into a wide variety of useable formats. Additionally, the systems described use a real time clock which takes more electrical power and adds to circuit complexity than the system of the present invention. This also requires that the clock be reset for time changes and for different time zones.

Regardless of the type of coin operated system, the basic requirement is that the value of a deposited coin be promptly and accurately recognized. Once this is accomplished, a variety of options are available. For example, coins of a detected value may be separately stored in well known coin storage systems i.e., pennies, nickles, dimes, quarters dollars. From such segmented storage systems, change may be provided or return of deposited coinage may be enabled. Paper currency readers may be used to provide change or the difference between the price and the amount deposited.

In large measure the problem is that paper currency units which provide change have to be loaded with the change to be dispensed. Such units provide a security problem in which both the deposited currency and the stored coinage are subject to theft by break in. Accordingly, the use of such systems has been limited to well populated areas and high traffic areas, e.g., hotels, airports and the like. Placing such equipment in less populated and low traffic areas, such as newspaper vending equipment, seems to invite theft by breaking into the equipment usually located in a remote area or an area which at times is effectively remote. The other objection is the "float", i.e., the need to tie up money by having it in the machine to dispense change. This may be a major concern for large vending machine operators with a larger number of vending machines.

One solution to this problem is to store the deposited coinage and use that source of deposited coinage to provide change, thus avoiding the need initially to load the machine with change and minimizing the effect of the float. That, however, requires that the value of deposited coinage be identified accurately and stored in conventional change or coin return bins. The result is that coin vending machines are usually relatively high priced for the item dispensed. This forces the machine vendors to price their products in terms of the increment of change provided. In some cases machines will accept nickles, dime and quarters and provide change in those denominations. However, those machines are complex and require external 110 volt operation and are generally located only in well lighted and well travelled or populated areas.

It is thus apparent that a need exists for a reliable electronic coin operated mechanism capable of accepting a wide variety of coin combinations currently in circulation and which may be adapted to accept foreign coins for equipment destined for use in foreign countries.

It is also apparent that a need exists for a reliable electronic coin mechanism which may be installed in currently existing equipment or new equipment and which may be battery operated and which is capable of reliable and accurate operation over a relatively long period of time and over a wide variation in ambient temperatures, e.g., −40 degrees to 185 degrees F.

Also apparent is the need for a unique and reliable coin mechanism, electronically operated and which is capable of electronically recognizing coin values of a variety of different coins, and which prevents tampering and which provides false coin detection, e.g., slug detection for the particular coin system.

Especially advantageous is the provision of a coin operated vending device which is battery operated, which provides a reliable coin mechanism for various denominations of coins, which totals the deposited coins to determine whether at least the purchase price has been deposited and which is capable of operating over a wide variety of environmental conditions, i.e., extremes of heat and cold and in damp freezing and dry hot conditions.

It is also apparent that a need exists for a reliable and accurate coin recognizing device which effectively can determine the value of a coin, or reject the same, thus allowing totalizing of coins according to value.

Another advantageous coin operated dispensing system is one which provides security and security levels through controlled passwords, accumulates and provides data related to equipment location, amount of articles loaded, amount of articles sold, amount of articles returned, amount of money deposited, amount of money collected, time of deposit of money, time of collection, identity of collector, time of servicing, test of battery condition, thereby enabling production of various management reports and reports related to the service of the equipment.

BRIEF DESCRIPTION OF THE INVENTION

The present invention relates to an integrated electronic dispensing system and more particularly to an improved electronic system for the sale of newspapers from machines or from other street sales facilities.

In a preferred form the newsrack is equipped with an electronic mechanism which recognizes the coins deposited and if at least the correct amount of valid coins are deposited, permits access to the interior of the dispenser. Usually this is accomplished by permitting the machine door to be opened. The machine electronics stores a wide variety of information such as total amount deposited, machine identification number, and relative time of the first and last sale as well as relative time of each sale. By relative time is meant elapsed time rather than chronological time. The electronics of the machine, powered by a battery, operates in a low power sleep mode to conserve power, until activated by deposit of a coin. When activated, the machine system is powered up to perform a variety of functions including coin denomination recognition, summing of valid coins deposited and comparison against the purchase price, identification of relative time, and release of the door lock to permit access if at least the correct amount of money is deposited. The deposited money then falls to the machine bank. The total amount of valid coins are totalized. If less than the purchase price is deposited or invalid coins or slugs are deposited, the deposited coins or other items are diverted to a coin return and the door remains locked.

The coin recognition system is unique in that it accepts and reads the value of each increment of coins from one cent to a dollar, for example, each of which is deposited sequentially in a coin chute. A rotatable coin wheel having a predetermined number of apertures with a single light source and a single detector is used for coin recognition in a unique way to be described. The use of a single light source and detector reduces the power needed for operation.

Used with the machine electronics is a reader, a portable hand held and battery operated unit which is capable of performing several different operations which will be described in detail. The reader can be used to read out raw information stored in the machine electronics by optical coupling to the electronics, typically relative time of first and last sale, relative time of each sale, battery condition, price options allowed, and the like. Additionally, the reader can program the machine electronics for price changes and for enablement of a slug detector system. The reader may be used by a route person who services the machine to record papers loaded and returned, time and date of service, time of first and last sale, total amount in the machine bank and a variety of other information to be described. A separate reader may be used by the person collecting the money in the coin bank. The permissible reader uses may be controlled by programming the reader, as will be described. The reader may optionally include an acoustic modem for transmission of information by telephone. The reader also includes an optical information transmission system.

Another part of the system is a shuttle mechanism which interconnects the reader to a computer, the latter receiving information from the reader for processing by software in the computer. The shuttle can also be used to program the reader by the computer. In effect the shuttle acts as an interface between the reader and the computer.

As will be described there are a series of security levels built into the system which limit what level of management or users can make changes in the system. For example, each machine is given a unique code identification which cannot be changed other than by the manufacturer or by information maintained by the manufacturer. This precludes machine code identification changes and thus prevents use of stolen machines. The reader can be programmed to read only those machines whose identification is programmed into the reader, for example machines on a defined route. This prevents the reader from accessing or operating machines other than those on an assigned or defined route. The reader cannot be accessed except through a personal identification code. The computer may store other information related to machine location, route person identification and a whole host of other information which, with the information provided from the reader, may generate a series of meaningful management reports. In this way productivity is increased and thefts are reduced.

It will be apparent from the following detailed description that the present invention offers a versatile and improved electronic dispensing system and mechanism. The following description should be considered a description of the invention, as illustrative of the same, and not as a limitation on the same.

DETAILED DESCRIPTION OF THE DRAWINGS

DETAILED DESCRIPTION OF THE INVENTION

Figure 1:
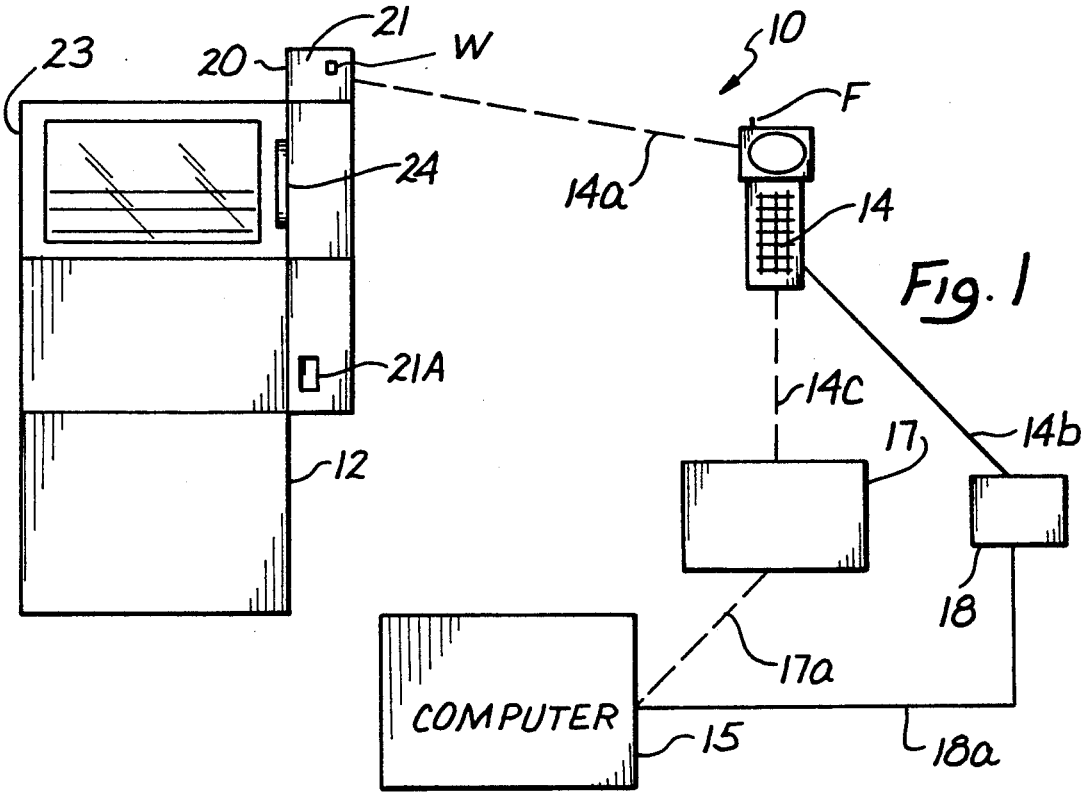
FIG. 1 is a diagrammatical view of the system of this invention for purposes of description thereof.

Referring to FIG. 1, the entire system 10 is illustrated in diagrammatic form for purposes of explanation. As seen the system 10 includes a coin operated dispensing device 12, shown as a newspaper dispensing machine, although it is understood that the dispensing device may be any coin operated device, as previously noted. The system also includes a reader 14 which may be used to input or readout information from the dispensing device 12 as indicated by line 14*a*. Also part of the system is a computer such as an Apple or IBM or compatible computer 15. Another component of the system is a shuttle mechanism 17 used to interface the reader 14 to the computer 15, as indicated by lines 14*c* and 17*a*, as will be described. It is also possible to interface the reader 145 to the computer via modem 18, as indicated by lines 14*b* and 18*a*.

In the form illustrated, the dispensing device is a newspaper vending machine including a coin mechanism 20 through which coins are serially or sequentially inserted through a single slot 21 dimensioned to accept coins of all diameters. If at least the proper total amount of coinage is inserted, then machine mechanism, to be described, allows the dispensing device to access the product to be dispensed or to start the service to be provided, e.g., clothes washing or drying, or pay telephone operation. In the case of a dispensed article, such as a newspaper, the purchaser may open the door 23 by the handle 24 to remove one paper, the papers being stored in the lower portion of the machine on a spring loaded platform, as is well known in the art. If the amount of coinage deposited is less than the purchase price, the deposited coinage is returned through the return slot 21*a* as the user attempts to open the door or, in the case of a pay telephone, hangs up the receiver. Again, this operation is well known in the art.

Figure 2:
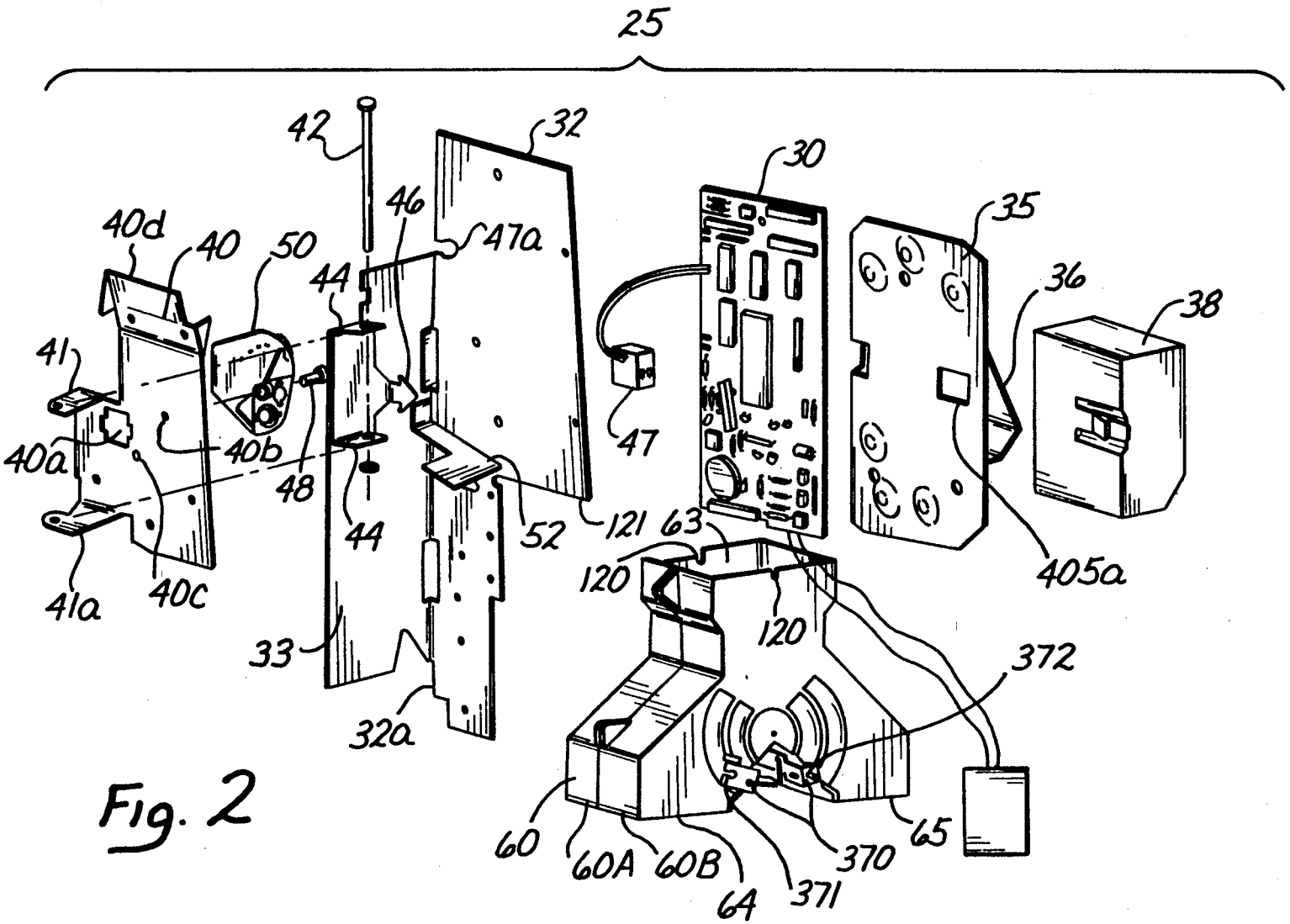
FIG. 2 is a diagrammatic illustration in an exploded view of the coin mechanism and electronic components of the coin mechanism in accordance with this invention.

The coin mechanism of the dispensing device 12 in accordance with this invention includes a unique electronic coin mechanism and associated electronics which perform a wide variety of functions. FIG. 2 illustrates an overall view of a preferred form of the electronic coin mechanism in accordance with this invention, although the present invention is not limited to what is illustrated and described in FIG. 2.

As seen in FIG. 2, the electronic coin mechanism 25 of the present invention includes an electronic control board 30 mounted on a support structure 32 on which other components are mounted. The detailed features of the electronic control board will be described. The support structure 32 also forms part of the coin chute and includes a lateral plate 33 upon which other components forming the coin chute and coin counting mechanism are mounted. Also mounted on the support structure on the side opposite the control board is a battery mounting plate 35 having a bracket 36 to form an enclosure which receives a unique removable battery pack 38, also to be described.

The other portion of the coin chute includes plate 40 having two ears 41 41*a* for receiving pin 42 to mount the plate pivotally on lateral plate 33, the latter provided with pin ears 44. One or more coil springs having finger extensions, not shown, is mounted on the pin 42 and one finger of the spring bears against the side of the plate and the other finger is placed in the spring finger 46 to bias the plate 40 and the components carried by the plate towards the support structure 32. As seen, plate 40 includes an aperture 40*a* for receiving a light detector housing assembly 47 for a light detector in the form of a photodetector, the latter being electrically connected to the electronic control board 30, the wires fitting in a grommet in slot 47*a*. The light detector assembly may also include a magnet mounted in the lower portion of the housing assembly for slug detection, preferably magnetic and which will be described.

Rotatably mounted on plate 40 by a pin 48 received in aperture 40*b*, on the side thereof facing support plate 32, is a coin wheel assembly 50. Thus, in the normal biased position of plate 40, the coin wheel assembly is positioned between plates 40 and 32, the latter forming a coin chute. Also mounted on plate 40 is a coin guide 40*d* which guides inserted coins into the coin chute and from there to the coin wheel assembly. Plate 40 also includes an aperture 40*c* for receiving a pin for an anti-bounce wheel mounted for cooperation with the coin wheel assembly. Lateral plate 33 also includes a lower coin guide plate 52, located below the coin wheel assembly to guide coins from the coin wheel assembly into a coin escrow unit 60. The coin escrow unit 60, similar to that previously used in pay telephone booths, is mounted such that coins from the coin plate 52 enter the top opening 63 of the escrow unit. The escrow unit includes two discharge openings 64 and 65, one which 65 allows coins to fall into the bank and the other which 64 allows coins to fall into a coin return chute.

Figure 3:
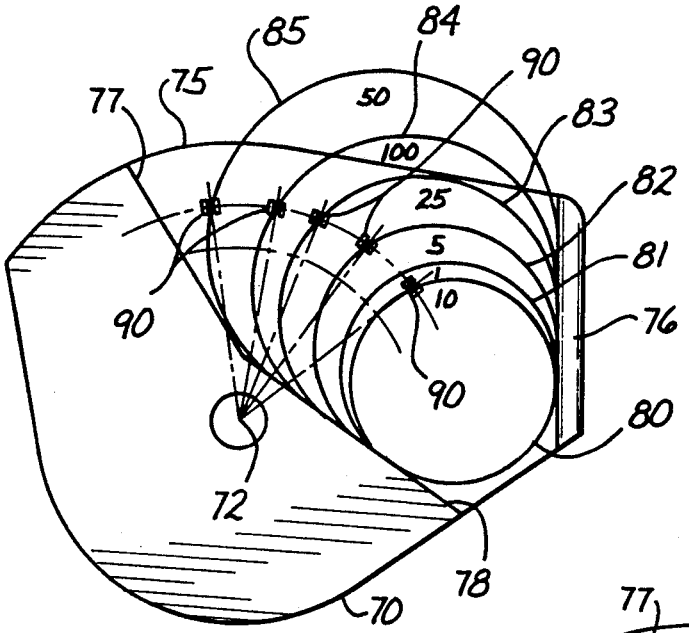
FIG. 3 is a diagrammatic illustration of a coin wheel in accordance with this invention.

FIG. 3 is a diagrammatic illustration of the coin wheel 70 which is of non-magnetic material such as acetal plastic and is non-symmetrical, having an axis of rotation at 72. As seen, the coin wheel 70 rotates clockwise from a rest coin receiving position to a coin release position and then counterclockwise back to the rest position. In the coin release position, the coin drops into the escrow unit 60 by gravity. The wheel includes a coin receiving section 75 effectively formed as a flat recess between shoulder 76 and inclined shoulder 77 which joins with shoulder 78. The depth of the recess is sufficient to accommodate coins of different thicknesses. As seen, shoulders 76 and 78 are coin receiving shoulders in the sense that spaced peripheral sections of a coin contacts both of these shoulders. Shoulder 77 is a guide shoulder to urge the coins into contact with the coin receiving shoulders. As illustrated, current American coins of the various values are illustrated, i.e., a dime 80, a penny 81, a nickel 82, a quarter 83, a dollar 84 (Susan B. Anthony coin) and a half dollar 85. These respective coins are each of a different diameter, a practice adopted by most major countries. Shoulders 76 and 78 form an acute angle effectively to amplify the diameter difference of coins. It is understood, however, that the invention is not limited to American coinage but may be used with any coinage in which the value of the coin is represented by a different effective diameter. For example, Canadian coins are basically the same diameter as American coinage. However, Canadian coins are magnetic. In each instance the coins are of different diameters and include two separate peripheral surface regions which contact each of shoulders 76 and 78. The coin wheel also includes a plurality of apertures 90, generally oriented in a particular orientation which is essentially arcuate as measured radially from the axis of rotation 72. As each coin is deposited in sequence, it travels to the coin wheel which is in the coin receiving position, as illustrated, rotates to the coin release position, then back to the rest position for reception of the next coin.

Figure 4A:
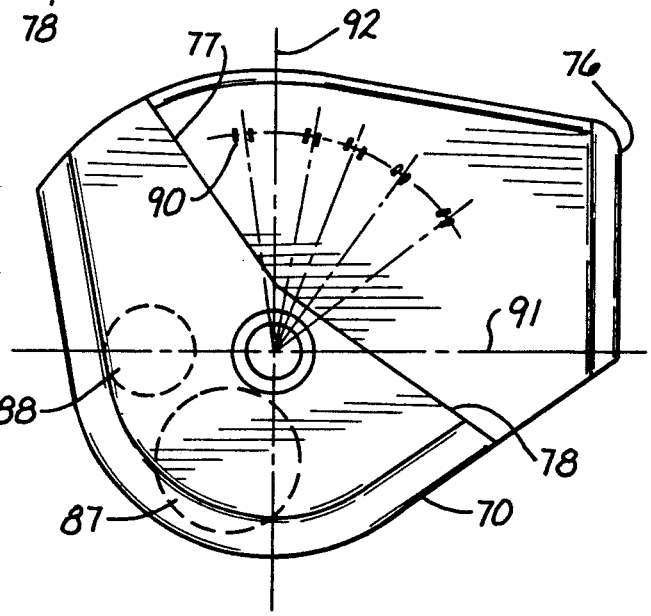
FIG. 4A is an enlarged view of the front side of a coin wheel in accordance with this invention.
Figure 4B:
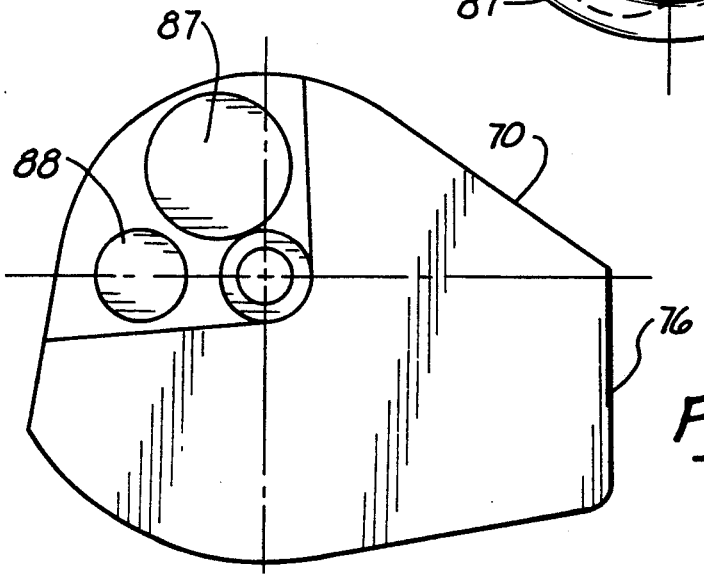
FIG. 4B is a view similar to FIG. 4A showing the back side of the coin wheel.

Referring to FIGS. 4A and 4B, the back side of the coin wheel may include two apertures 87 and 88, the former receiving a weight and the latter a magnet. FIG. 4A also illustrates the general orientation of the apertures 90. This figure also illustrates two reference lines 91 and 92 which form a 90 degree quadrant. Shoulder 77 is about 35 degrees to the left of reference line 92 while shoulder 76 is parallel to reference 92 and perpendicular to reference 91. Shoulder 78 is oriented at an angle of about 55 degrees as measured clockwise from reference line 91. Since the wheel 70 is non symmetrical, the combined weight of the magnet and weight and their respective locations cause the wheel, absent the presence of a coin or other item of weight, to come to rest in a balanced coin receiving position as illustrated in each of FIGS. 3 and 4A. As any single item, coin or slug or anything having any weight reaches the coin receiving section an imbalance condition is created causing the coin wheel to rotate clockwise as seen in FIGS. 3 and 4A. In the event, for some reason, that a coin does not come to rest in the coin receiving section, e.g., passes through between the inside face of the coin wheel and the facing wall of the coin chute, it is not counted and drops into the escrow section 60. That action is a null action for coin determination and summing purposes. Effectively, such a null action produces no response in the mechanism.

During clockwise rotation of the coin wheel 70 in response to a weight increment, two series of events are started. Since the electronics control system of board 30 (FIG. 2) is in a dormant state to conserve battery power, as will be explained, the first event is to activate the electronics. This is accomplished by the first incremental movement of the magnet in aperture 88 of the coin wheel, the latter activating a reed switch on the control board 30. Since all of the supporting structures and plates in the electronic sensitive region of the coin mechanism are non-magnetic, i.e., stainless steel and the like, a small rotational angular displacement of the coin wheel activates the electronics. The second event is that the coin value is read by the electronics. The coin reading mechanism, to be described, is angularly located with respect to coin wheel rotation such that the electronics are activated prior to the time that leading aperture (right most opening clockwise) reaches the coin reading system. The relative position of the start of a coin read sequence is when the coin wheel has rotated about 35 degrees, i.e., when shoulder 77 has rotated to the relative position of reference line 92 as seen in FIG. 4A.

Since the electronics of the control board is in a dormant state because magnet 88 controls the electronics activation reed switch, the angular movement of the coin wheel representing the arcuate movement of the magnet, which arcuate movement is less than the arcuate movement needed to bring the aperture into line with the coin read system, the effect is that the electronics are activated well prior to the time in which it is necessary to start a coin read sequence. In the system described, the electronics are activated well before the coin wheel has rotated 35 degrees from the coin receiving or rest position. So too, as the coin wheel rotates counterclockwise to the rest position, apertures traverse the detector before the magnet arrives in alignment with the reed switch, the result is that the electronics are then placed in a dormant state, but remembers the values or null reading of the previously deposited coins and the like. This mode of operation conserves battery power.

Figure 5A:
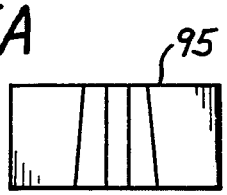
FIG. 5A is an enlarged view, in section, of the slots in the coin wheel.
Figure 5:
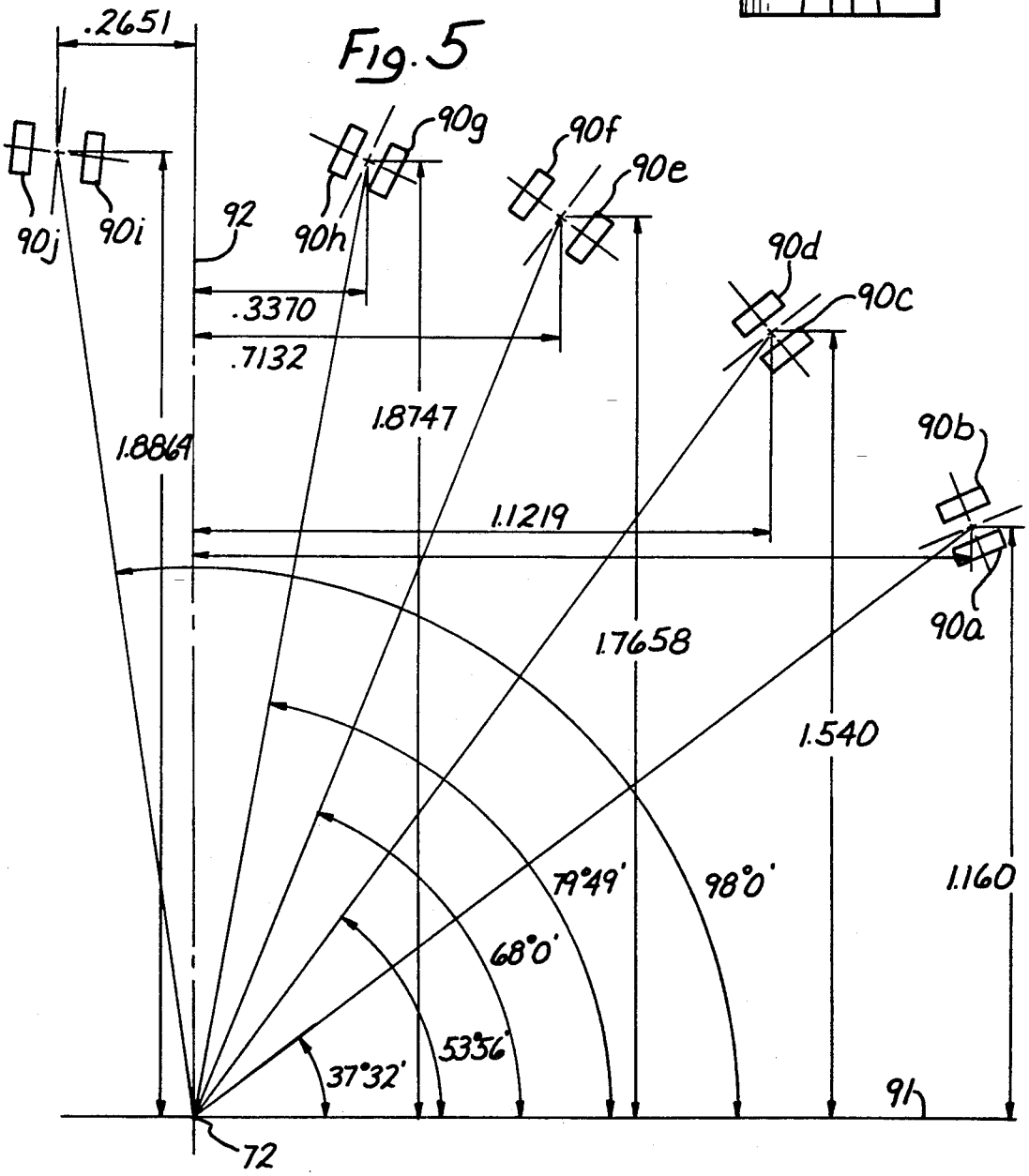
FIG. 5 is an enlarged diagrammatic view of the orientation array of the slots located in the coin wheel in accordance with this invention.

Referring now to FIGS. 5 and 5A, wherein the same reference numerals have been used for parts already described, the predetermined orientation of the array of apertures 90 is illustrated with reference to United States coinage, and Canadian coinage, as will be described. Overall, the format is to provide a series of related and oriented apertures such that coinage of different diameter dimensions may be accurately identified. To identify the value of various coinage in accordance with this invention, the array preferably includes pairs of apertures, **90*a*–90*b*, 90*c*–90*d*, 90*e*–90*f*, 90*g*–90*h* and 90*i*–90*j***.

As seen in FIG. 5, the apertures **80*a*–80*j*** are oriented in a unique configuration and are oriented in arcuate pairs already identified. The purpose of using pairs of apertures is to be able to distinguish between the peripheral edge of a coin and the body of a coin, the distinction being made based on coin diameter. The overall purpose of the aperture arrangement is to provide a pulse count which is unique to each coin, basically measured on the basis of coin diameter. Thus, each coin of different diameter will provide a unique pulse count which is recognized or rejected by the electronic control board. If the slug detector is deenergized, as will be described, then Canadian coins may be detected and counted.

One of the unique features of the coin recognizing system of this invention is that pulses are counted in both the clockwise and counterclockwise movement of the coin wheel. For example, there are five pairs of 2 slots, totalling 10 slots in the clockwise direction and 10 slots in the counterclockwise direction. The principal purpose of counting light pulses through the slots in both the clockwise and counterclockwise direction is to eliminate errors due to mechanical shocks of the equipment such as the door slamming or vandalizing. This may cause a pulse or series of pulses and a deceptive pulse count if pulses are counted only in one direction of coin wheel rotation. This also prevents erroneous coin identification if a user jogs or shakes the machine during use.

To avoid this problem, in accordance with this invention, pulses are counted in each direction of rotation of the coin wheel. The effect is that shocks will not produce a pulse count equal to the value of a coin. Assuming the American coins mentioned, the recognized pulse counts based on coin diameter are as follows:

| Coin | Forward count | Back count | Total count |
|---|---|---|---|
| void | 10 | 10 | 20 |
| dime | 9 | 10 | 19 |
| penny | 8 | 10 | 18 |
| nickel | 7 | 10 | 17 |
| void | 6 | 10 | 16 |
| quarter | 5 | 10 | 15 |
| void | 4 | 10 | 14 |
| dollar | 3 | 10 | 13 |
| void | 2 | 10 | 12 |
| Half/dol | 1 | 10 | 11 |
| void | 0 | 10 | 10 |

From the above table it can be seen that each coin has a predetermined number of pulses unique to that coin and in general, the smaller the diameter of the coin, the larger the total number of pulses. The number of pulses representing a particular coin diameter and thus the value of the coin are stored in memory in the electronic control board 30. As will be described, the same number of pulses are generated by American and Canadian coins. The distinction, however, is whether the slug detector is activated or not. It is apparent that for coin dimensions other than those described, for example, foreign coins other than Canadian coins, a different number of pulses may be needed. Also, a greater number of apertures may be needed and/or location changed depending on the variety and sizes of the coins. Thus, in normal operation, one coin at a time is deposited. The deposited coin's value is determined and stored and the coin drops by gravity either to the escrow 60 or to some other unit, depending upon the nature of the machine.

Another advantage of the clockwise and counterclockwise pulse counting is that only a single light source and detector need be used to obtain fast and accurate counts. In this way, the battery power requirements for operation of the coin identification and coin counting is kept relatively low thereby assuring power for the unit over a longer period of time.

Figure 6:
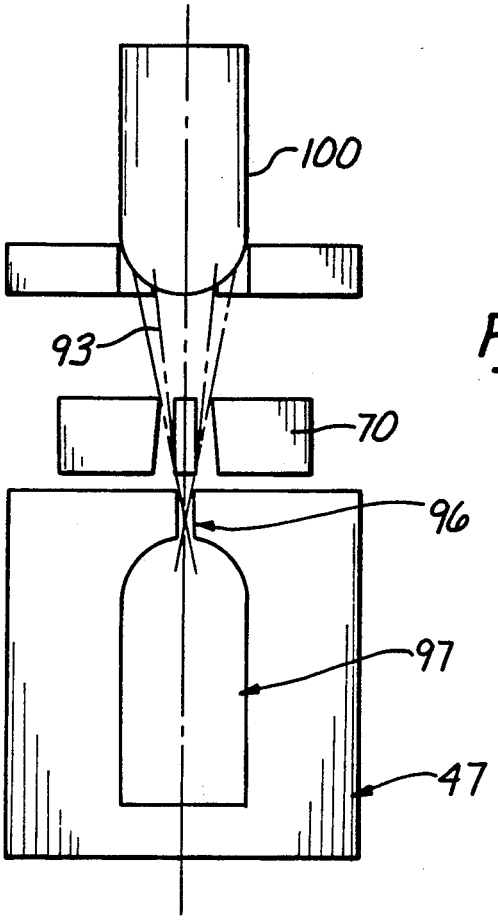
FIG. 6 is a diagrammatic view, for purposes of explanation, of the electronic coin detection system of this invention.

Referring now to FIGS. 5A and 6, is a light source such as a light emitting diode 100 is located on the electronic control board 30 and is aligned to project light through each of the apertures 90*a–j* on the coin wheel 70. Located to the side of the coin wheel 70 opposite the coin receiving surface and aligned with the LED is the detector housing assembly 47, the housing having a rectangular opening 96 through which transmitted light passes to the photodetector 97. The result is that a very short series of discrete and countable light bursts reach the photocell from the LED, in accordance with the number of apertures which are open for light transmission.

Referring now to FIG. 5, the coin apertures are oriented with respect to reference lines 91 and 92 and the axis of rotation 72. The apertures are rectangular slots, arranged as follows, with respect to the center point between adjacent slots:

| Slot | Angle fr/91 | Dist. fr/91 | Dist. fr/92 |
|---|---|---|---|
| 90a–b | 37 32 | 1.160 (.4568) | 1.510 (.5947) |
| 90c–90d | 53 56 | 1.540 (.6063) | 1.1219 (.4417) |
| 90e–90f | 68 0 | 1.7658 (.6952) | .7132 (.2808) |
| 90g–h | 79 49 | 1.8747 (.7381) | .3370 (.1327) |
| 90i–j | 98 0 | 1.8864 (.7427) | .2651 (.1044) |

The angular dimensions are in degrees and minutes, the distance dimensions are is centimeters and inches. The distance dimension for 90*i–j* from reference line 91 is taken counterclockwise from 91. The dimension of the slots themselves is 0.0381 (0.015) by 0.101 (0.0400). These dimensions are by way of example only.

If the slug detector is deenergized, all Canadian coins will be accepted, provided they have diameters falling within diameters controlled by the radial distance between adjacent slot pairs. The result is that if set to American coins, by energizing the slug detector, all magnetic coins will be rejected and only those nonmagnetic coins having U.S. coin dimensions will be counted. If the slug detector is deenergized, all coins having the dimensions responding to the arrangement of the slot pairs will be accepted. While not an absolutely fool-proof system, the system of this invention is able to make basic distinctions between coins of various diameters and those which are magnetic and accordingly to make distinctions between Canadian and American coins of essentially the same diameters based on the magnetic response. The effective result is that all magnetic coins, regardless of origin may be rejected in an American system, while magnetic coins may be accepted, based on dimensions. This offers a major advantage of coin operated near the American-Canadian border.

Figure 7:
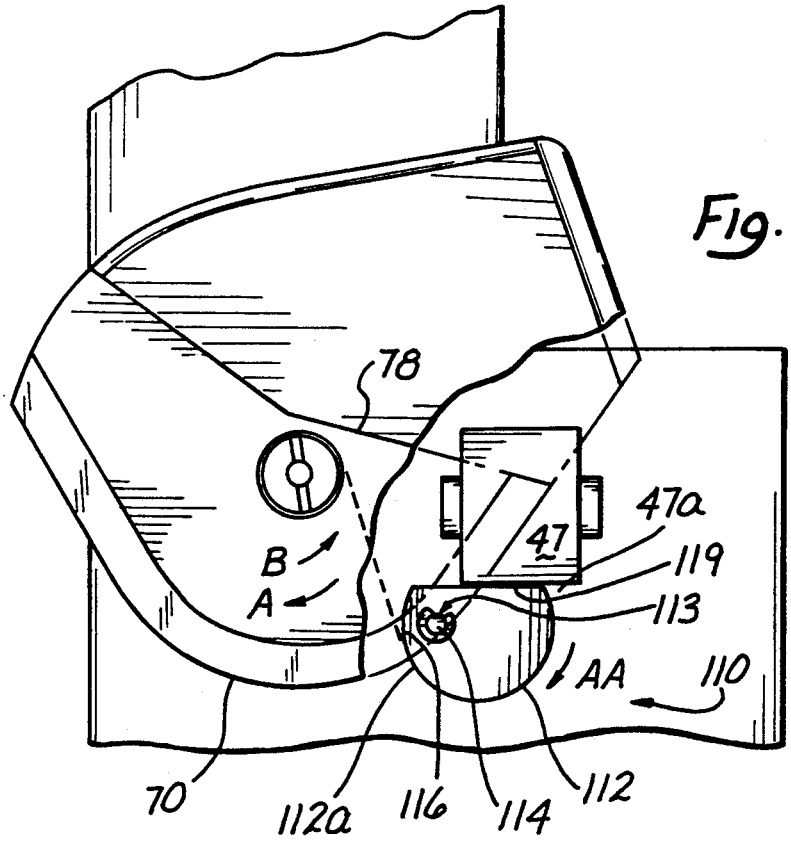
FIG. 7 is an enlarged view of the anti-bounce wheel used with the coin wheel in accordance with this invention.

FIG. 7 is an enlarged view of an anti-bounce unit 110 used with the coin wheel 70 to inhibit the effects of bouncing of the coin wheel as it rotates back to the start position. Bounce may occur because of the speed at which the wheel returns. Mounted on the same plate on which the coin wheel 70 is mounted is a bounce plate 112 in the form of a half-moon. The bounce plate is eccentrically mounted by pin 113 received in aperture 40*c* and the pin spaces the plate from the plate upon which it is mounted. The bounce plate rotates about axis 114 initially in a clockwise direction from the position shown. The plate 112 is received between the support plate and the reverse side of the coin wheel and close to the light detector housing assembly 47. For orientation purposes, 116 is the shoulder on the reverse side of the wheel and that adjacent to where the weight is mounted. Shoulder 78 is as already described.

As the coin wheel rotates clockwise, as indicated by arrow A, the bounce plate 112 is rotatable in the same direction on axis 114 as indicated by arrow AA. This rotation causes face 119 to be angularly spaced from the bottom wall 47*a* of detector housing 47. As the coin wheel rotates counterclockwise, as indicated by arrow B, shoulder 116 impacts the side wall 112*a* of the plate 112. This transfer of return energy from the wheel 70 to the bounce plate 112, effectively a shock absorbing action, effectively prevents the coin wheel from bouncing.

In certain uses of the coin mechanism of this invention, it is desirable to provide an escrow unit, although the latter is not required in all uses. For example, in newspaper vending machines or other vending machines (pay telephones) in which a minimum value of coins must be deposited or the incorrect amount of coins returned, an escrow is desired. In effect, the escrow is a temporary storage area for the deposited and counted coins. As the user tries to access the product being dispensed or use the service available, either the correct minimum amount of coins is permitted to drop into the machine bank or, in the alternative, directed to a coin return chute. Such a system is typical in newspaper vending machines, pay telephones or other types of coin controlled vending machines.

The escrow unit 60 illustrated in FIG. 2 is one such unit and is patterned after that used in pay telephones, except that the control members of the escrow unit in accordance with this invention are materially different, as will be described. As shown, the escrow is made up of two half body sections 60*a* and 60*b*. At the top, each body section includes a slot 120 into which the bottom end 121 of plate 32 is received for alignment. This orients the coin plate 52 such that coins are directed to the open end 63 of the escrow. The escrow includes two discharge openings 64 and 65 as already described.

Figure 8:
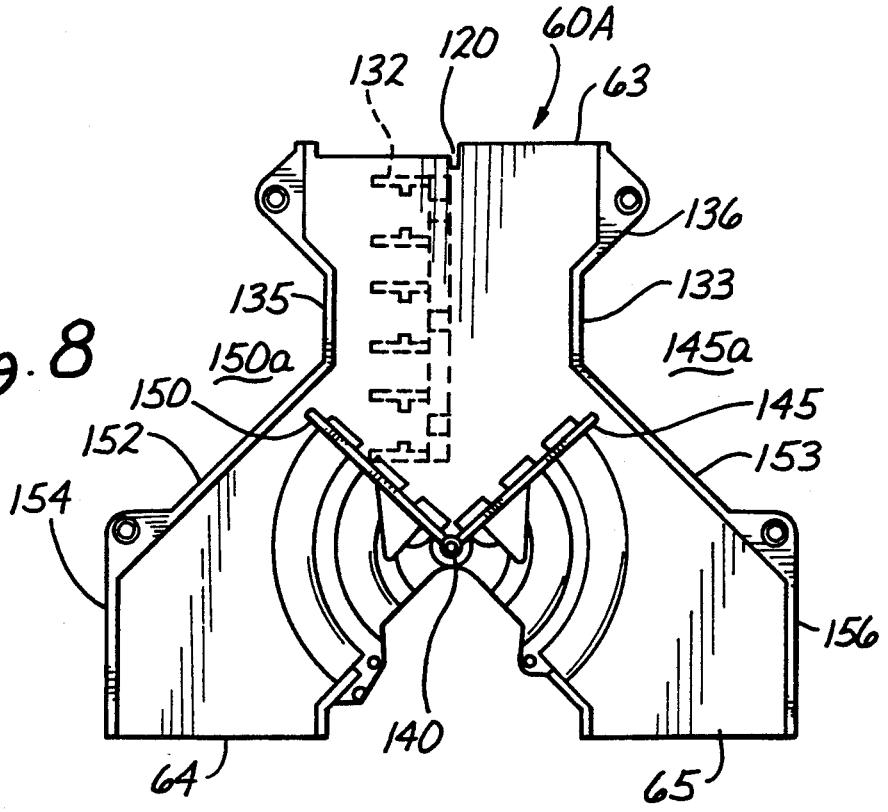
FIG. 8 is a view, as seen from the interior, of one half portion of an escrow unit in accordance with this invention.

Referring to FIG. 8, one half section of an escrow unit 60 is illustrated as seen from inside the unit. Since each half section is essentially the same, except as noted, only one half will be described. This particular half 60*a*, unlike the other half, includes a mounting section 132, in phantom lines, extending from the rear side of the unit for mounting on a support structure. Below the open end 63, there are inwardly projecting side wall sections 133 and 135 such that the clearance or distance between these side walls is less than that between the top wall section 136. Centrally located between the discharge exits 64 and 65 and below the side walls 133 and 135 is a pivot pin aperture 140 which receives a pin upon which escrow doors 145 and 150 are mounted. Door 145 pivots clockwise and door 150 pivots counterclockwise from the closed position shown to an open position. Below the inwardly projecting sidewalls 133 and 135 are inclined side walls 152 and 153, the latter terminating in downwardly extending wall sections 154 and 156. The purpose of the inwardly projecting side walls 133 and 135 is to prevent coins from falling into any space between the end face 145*a* and 150*a* and the facing inclined side walls. In basic operation, either both doors are closed, or one or the other, but not both are open.

Figure 9A:
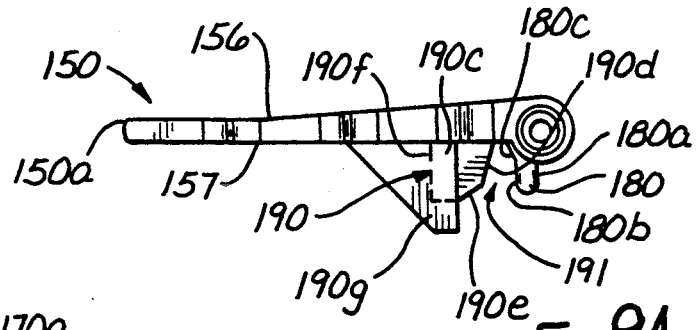
FIG. 9A is a side view of an escrow door in accordance with this invention.
Figure 9:
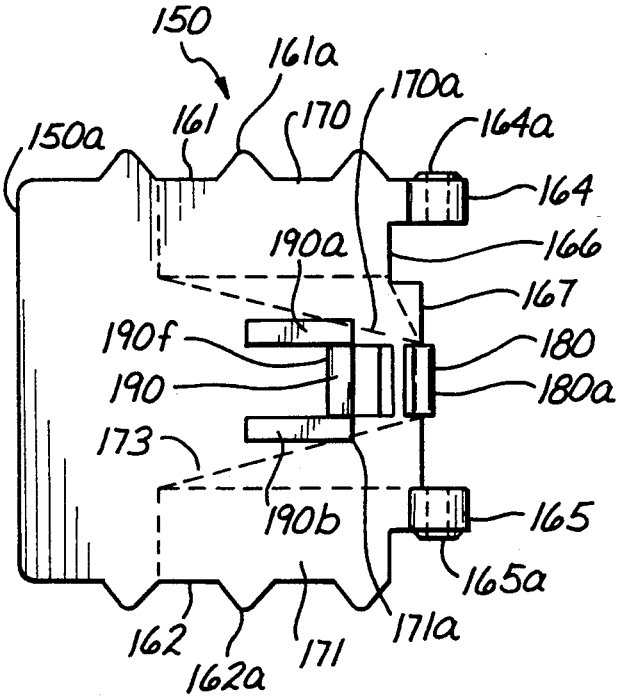
FIG. 9 is a plan view of an escrow door in accordance with this invention.

Referring to FIGS. 9 and 9A, the details of the door structure are illustrated. Since each door is of the same structure, only that of 150 will be described. Each door includes an upper surface 156 (see FIG. 9A) which faces the open end 63 of the escrow and a lower surface 157 which faces the open end of the discharge chutes. The side surfaces 161 and 162 are each provided with spaced laterally extending fingers 161*a* and 162*a* while the rear face includes spaced journals 164 and 165 with outboard bearing buttons 164*a* and 165*a*, a notched section 166 and an intermediate rear wall section 167 which is slightly recessed from the center line of the journals. When two doors are assembled together the journal corresponding to 165 of the second door is located in the notch 166 of door 150, while the journal of the second door corresponding to 164 is located outboard of journal 165 of door 150, the bearing buttons providing for ease of relative rotation.

The bottom surface 157 of the door 150 is essentially flat while the upper surface 156 includes tapered spaced sections 170 and 171 whose thickness increases towards the rear faces. Each tapered section includes an associated side taper 170*a* and 171*a* such that the generally triangular intermediate section 173 is essentially flat. This configuration permits wet coins to slip off the upper door surface more easily.

The bottom surface 157 of each door includes a door positioning control assembly which is both simple and effective. Extending downwardly from the bottom surface of each door adjacent the rear surface 167 is a door stop button 180. This button includes a rear face 180*a* which extends rearwardly of the rear surface 167 but just short of the centerline of the journals. The front face 180*b* of the button is located inwardly of the rear surface and include a tapered base 180*c*. Spaced inwardly and in alignment with the door stop button is a door opening button 190 thus forming a groove 191 between the buttons. The door opening button 190 includes spaced side arms 190*a* and 190*b*, with a guide button 190*c* therebetween, the latter including tapered faces 190*d* and 190*e*. Rear wall 190*f* of the guide button is located between side arms 190*a* and 190*b*, the latter each including an upper end 109*g* which extends beyond the upper surface of the guide button. In operation, a guide control element either contacts the wall 180*b* of the door stop button, halting rotation of the door or travels up inclined faces 190*d* and 190*e* to urge the door to a closed position as the control element rests between the top of the guide button and the upper end of the side arms. Thus with the doors in planar alignment and angularly oriented in the escrow either the coin return chute or the bank chute is open. If one is open it is not possible for the other also to be open since the rear faces of the stop buttons bear against each other preventing further rotational movement. It is, however, possible for the doors to close each of the chutes. This represents a relative orientation in which the upper faces of the doors are at an angle less than 180 degrees.

Figure 10:
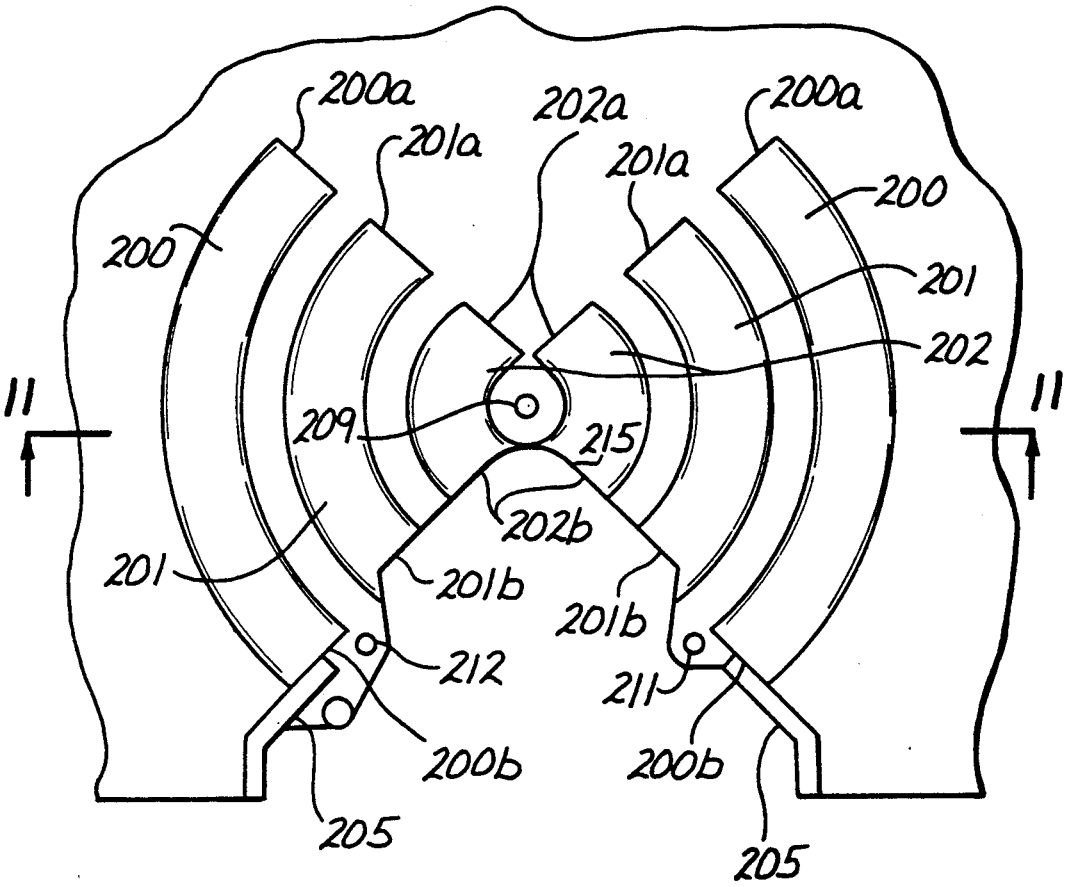
FIG. 10 is an enlarged fragmentary view of the lower portion of the escrow unit in accordance with this invention.
Figure 11:
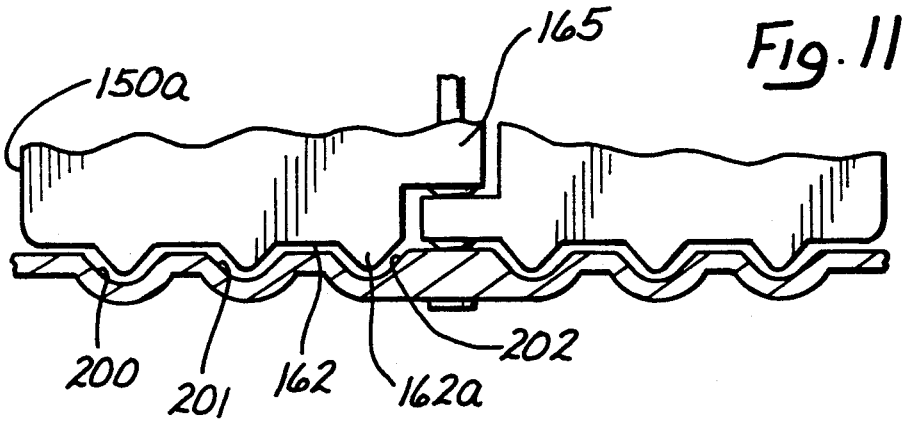
FIG. 11 is a fragmentary plan view of the escrow doors and the interior wall of the escrow unit.

FIGS. 10 and 11 illustrate another feature of the escrow unit which prevents coins from being wedged between the side walls of the doors and the opposing walls of the escrow housing. Each of the walls of the escrow housing facing the side walls of the doors includes a plurality of arcuately oriented depressions 200, 201 and 202 spaced radially. The ends 200*a*, 201*a* and 202*a* are in radial alignment and represent the closed position of the escrow doors. The ends 200*b*, 201*b* and 202*b* represent the full open position of the door, the latter bearing against and overlapping a lower wall section 205 which is radially oriented with respect to the axis of rotation 209 of the doors. As seen in FIG. 11, the fingers on the side walls of the door are spaced from the depressions for free pivoting motion of the doors while preventing coins from being wedged in the space between the side walls and the facing wall of the escrow housing. The escrow housing is open at the portion between the discharge chutes, i.e., from the region of pivot pins 211 and 212 to 215. These openings are provided for the door actuating lever mechanisms.

To understand how the lever mechanism for the escrow operates, it is necessary to understand the interface between the electronic control board and the escrow itself, since there are multiple functions performed. In one function, the assembly is in a stand-by or rest mode. The second function is to respond to a correct coin count and open the escrow door to the machine bank and permit access to the product or to commence the service. Alternatively, there is the function of rejecting the deposited coins as being insufficient, by maintaining the escrow door to the bank closed while opening the coin return door. Finally, there is the reset function in which the assembly returns to the stand-by condition.

Figure 12:
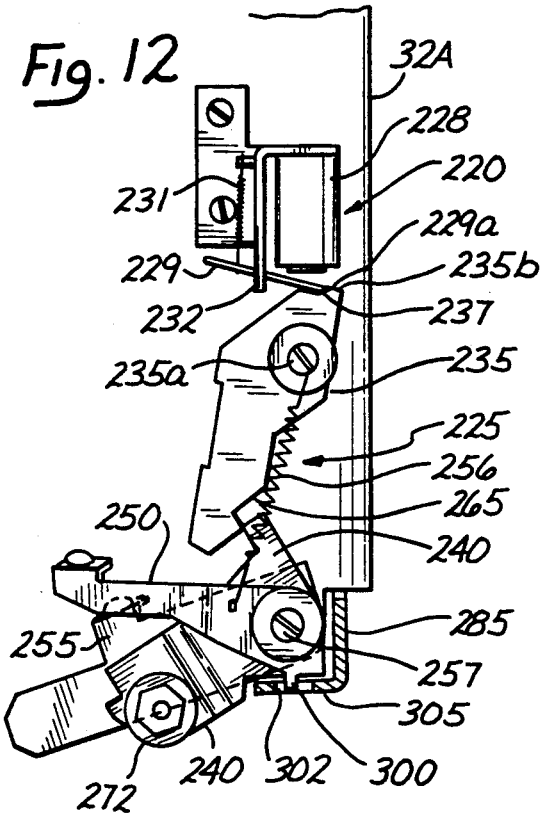
FIG. 12 is a diagrammatic illustration of the coin control lever assembly which operates the escrow unit.

Referring to FIG. 12, a solenoid assembly 220 and a lever assembly 225 are mounted on the rear side 32*a* of the lower portion of plate 32 (see FIG. 2), the latter being provided with apertures as illustrated. In effect, the assemblies 220 and 225 are mounted directly behind the escrow unit 60. The solenoid assembly includes a solenoid 228 which receives control signals from the electronic control board 30 in the form of a pulse each time and only if the proper amount of coinage is counted, as already described. Cooperating with the solenoid 228 is a magnetic actuator plate 229 normally biased by spring 231 around pivot point 232 in the clockwise direction in the view illustrated. When the solenoid is pulsed, the actuator plate pivots in the counterclockwise direction.

Pivotally mounted on plate 32*a* below the solenoid assembly is an essentially flat latch finger 235 which pivots on axis 235*a* (see also FIG. 14). The upper end of the latch finger includes an actuator plate lock shoulder 237 which receives the end 229*a* of the actuator plate. This is the rest or stand-by position. There is sufficient clearance between the bottom of the solenoid 228 and the top of lock shoulder of the actuator plate to permit the latch finger to rotate when the solenoid is pulsed. After a pulse, the top 235b of the latch finger is below the actuator plate until the latch finger is permitted to rotate clockwise. This maintains the latch finger in a locked orientation.

Figure 13:
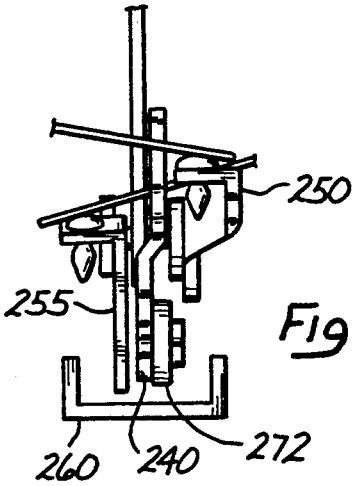
FIG. 13 is an end view of the assembly as seen in FIG. 12.

Located below the latch finger are three additional and independently rotatable levers, a coin finger lever 240, an escrow return finger 250 and a coin box finger 255 all pivotable around the same axis 257. The coin finger lever 240 is between the other two fingers with coin box finger 255 being behind the coin finger lever 240 and the escrow return finger 250 being to the front. The relative positions are also shown in FIG. 13 which illustrates the stand-by condition.

Figure 18:
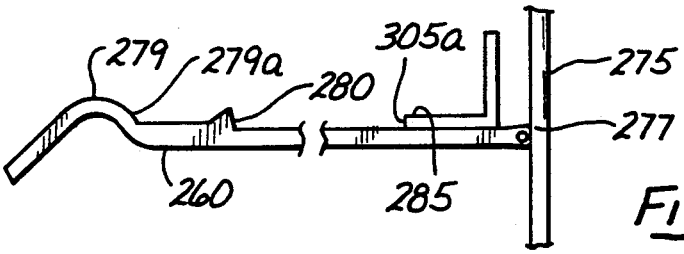
FIG. 18 is a diagrammatic view of the door latch assembly.

In the stand-by condition, all the fingers are in an upward position to close both the bank door and the coin return door of the escrow. The escrow return finger 250 is biased to the upward position by a coil spring 256. The coin finger 240 and the coin box finger 255 are held in the upward position by the door latch arm 260 (FIGS. 13 and 18) which is normally biased in an upward position.

Figure 14:
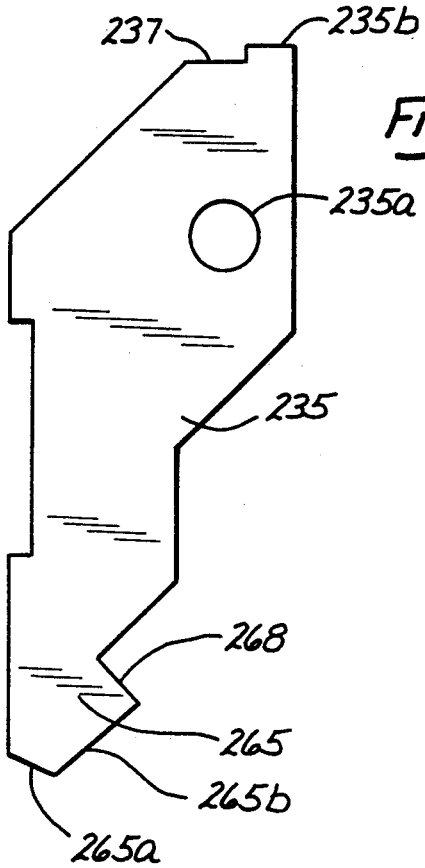
FIG. 14 is an enlarged view of the latch finger.
Figure 15:
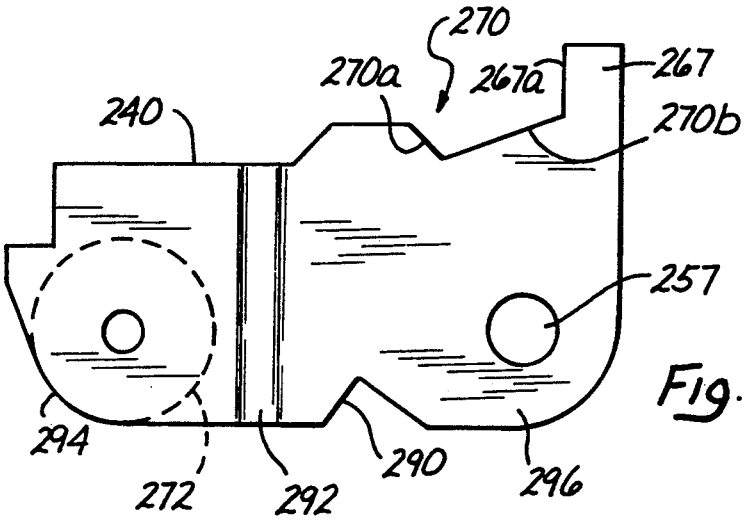
FIG. 15 is an enlarged view of the coin finger.

As seen in FIG. 14, the lower end of the latch finger 235 includes a coin finger lock face 265 which rotates as the latch finger rotates. As seen in FIG. 15, the coin finger 240 includes a lever reset surface 267a which can bear against reset face 268 of the latch finger 235. Adjacent the lever reset surface is a lock pocket 270 adapted to receive the lock face 265 of the latch finger as the latter rotates clockwise once the solenoid is pulsed. When locked, the lock face 265 is in the lock pocket 270 and the forward face 265a bears against face 270a of the lock pocket 270 whereby the coin finger is prevented from rotating counterclockwise around pivot 257. Face 265a is not parallel with the reset face 268, and face 270a is nonparallel with face 267a. However, the face 267a of the reset surface is spaced from the reset face 268. In this relative position the angular orientation of the reset face is nonparallel with the reset face 268. This relative orientation permits an unlock and reset sequence, as will be described.

The end of the coin finger 240 includes a disk like roller 272 which rides on the latch arm 260. If the coin finger is in the locked position, as the door 275 (FIG. 18) is pulled, the roller 272 causes the latch arm, biased in the clockwise direction by spring 277, to rotate in a counterclockwise direction as the roller rides over the latch arm cam 279. The coin box finger 255, normally biased to a downward position also bears against the latch arm.

The latch arm also includes latch arm tangs 280. For the door 275 to open, the latch arm tangs 280 must clear the latch stop 285. For the coins in the escrow to fall to the bank, the coin box finger 255 kept in the up position by the latch arm must freely rotate downwardly to open the coin box door of the escrow. Thus, with the coin finger 240 in the locked position, the roller 272 rides over the cam 279 before the tangs 280 reach the latch stop 285, thereby permitting the door to be opened since the tangs have cleared the latch stop. As the roller causes the latch arm to rotate counterclockwise the coin box finger rotates to the down position, opening the coin box door of the escrow and the coins fall into the bank as the tangs clear the latch stop.

A second series of events also takes place as the door is pulled to the open position. As the roller 272 starts to ride up the forward face 279a of the cam 279, the coin finger rotates a small amount clockwise. As the roller 272 clears the cam 279, the coin finger 240 is free to rotate counterclockwise causing surface 267a to contact surface 268 of the latch finger 235 causing it to rotate clockwise until the end 229a of the actuator plate drops into the lock shoulder 237. As the door is closed, the latch cam 279 rotates the coin arm to the rest position. As seen in this FIG. 15, the coin finger 240 includes a bend section 292 such that the end section 294 is laterally offset (behind as seen in FIG. 15) from the main body section 296 of the coin finger.

Figure 16:
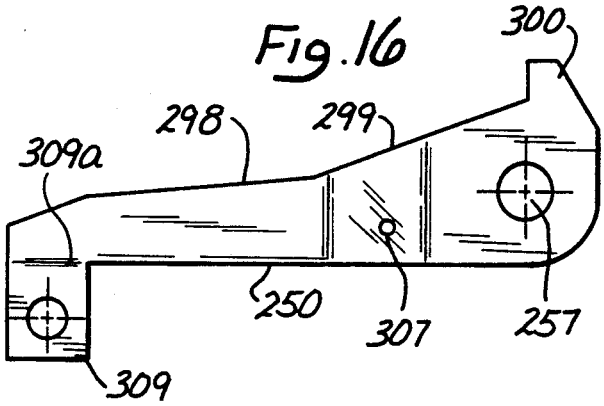
FIG. 16 is an enlarged view of the escrow return finger.

As shown in FIG. 16, the escrow return finger 250 is also non-planar and includes a bent section 298 bent outwardly at bend zone 299. The escrow return finger 250 rotates about axis 257 and includes a tang 300 received in an aperture 302 in the bottom section 305 of the latch stop 285. The bent zone 299 includes an aperture 307 for one end of spring 256 (FIG. 12) such that the escrow return finger is normally biased upwardly as seen in FIG. 12. The bent section 298 also includes at one end a button mounting tab 309 oriented 90 degrees as indicated by line 309a. That tab bears against the lever of the escrow which keeps the coin return door normally closed.

Figure 17:
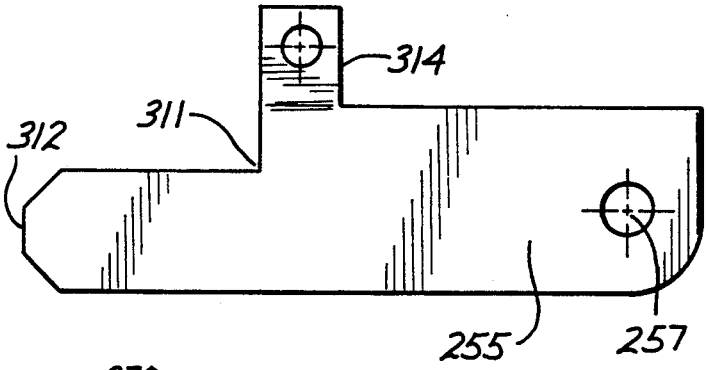
FIG. 17 is an enlarged view of the coin box escrow finger.

As shown in FIG. 17, the coin box finger 255 freely rotates about axis 257 and by gravity tends to be in a down position. This finger has an axial length greater than the coin 240 finger such that the portion from 311 to the end 312 extends beyond the end to the coin finger. Also located on the coin box finger is a button tab 314 which is 90 degrees bent and which extend to the side of this finger opposite the coin finger. In the up position, the button causes the coin bank door of the escrow to be closed. With door 275 closed, the door latch 260 urges the finger to the up position.

Figure 19:
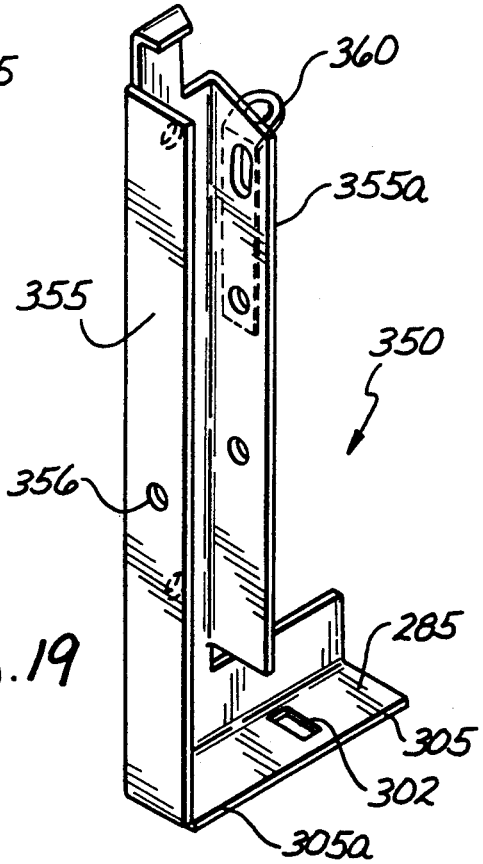
FIG. 19 is a diagrammatic view of the coin chute clearing assembly.

FIG. 19 illustrates the latch stop mechanism 350, portions of which have already been described. The coin return mechanism also includes a vertically extending, U-shaped, arm 355 joined to the latch stop 285. As the latch stop 285 is moved to the left as seen in the drawings, the entire latch stop mechanism pivots at pivot point 356, causing the upper end of arm 355 to pivot in the opposite direction. The latch stop mechanism 350 is mounted to the rear of the escrow, on plate 32a. The upper end of arm 355 includes bracket which fits and is mounted on the lower ear 41a (see FIG. 2) between the plate 40 and the pivot pin 42 which passes through the ear apertures. As the arm latch stop rotates to the left, the upper arm 355 rotates to the right. This causes plate 40 to rotate to the left about pivot pin 42 with the result that the coin chute is opened up to permit anything in the chute to drop into the escrow whose doors are normally closed.

In the event that an incorrect value of coins is deposited, the solenoid 228 is not pulsed and the latch finger 235 is not activated to lock the coin finger 240. Thus, the coin finger is free to pivot upwardly as the latch arm 260 is move in response to an attempt to open the door. The result is that as the cam 279 passes the roller 272, a sequence of lever movements is initiated. At the approximate relative position in which the roller 272 is at the top of the cam, the tangs 280 of the latch are portioned against the face 305a of the latch stop 285. The bottom surface of the escrow finger rides on the top of the cam. As the door is pulled further, the latch stop 285 is rotated to the left. Since the tang 300 of the escrow return finger 250 is located in the slot 302, the escrow return finger is rotated counterclockwise or in the down position, as seen in FIG. 12, and the escrow coin return door is opened. The coin bank door remains closed since the coin box finger 255 is in the up position. This sequence causes the materials in the escrow to drop to the coin return chute. However, a second and important sequence also takes place.

If correct coinage is deposited, the pulsing of the solenoid restarts the coin count sequence. Since depositing of the incorrect total amount of coins does not cause pulsing to the solenoid, some other mechanism is needed to restart the coin count or else the electronic control board will remember the value of the prior coins deposited and returned. Carried by the arm 355 in side leg 355*a* is a magnet 360, the latter aligned with a reed switch on the electronic control board 30 which is kept closed as long as the magnet is aligned. With correct coinage, the reed switch is closed since there is no movement of the magnet 360 since there is no action in the latch stop mechanism. However, for incorrect and returned coins, movement of magnet 360 opens the reed switch to reset the coin counter to zero.

Figure 20:
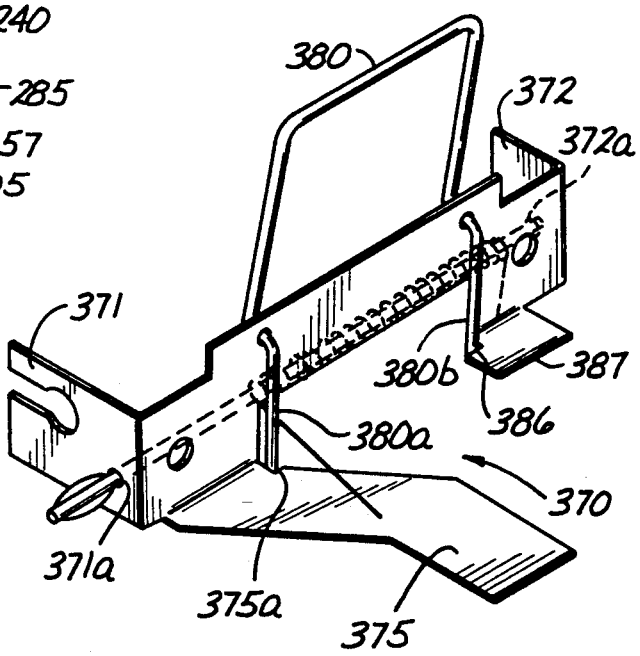
FIG. 20 is a diagrammatic illustration of the escrow door control levers.

FIG. 20 shows the escrow door levers 370 which are basically of the same structure and which are mounted on the escrow to control the escrow doors in response to the various finger levers controlled by the solenoid. Each escrow door lever includes spaced ears 371 and 372, each provided with an aperture 371*a* and 372*a* received on each side of the escrow housing an pivotally mounted, see FIG. 2. Each lever includes a lever arm 375 which in one case is contacted by the button on the escrow return finger and in the other case contacted by the button on the escrow coin box finger. The lever arm 375 is used to rotate the lever in response to movement of the respective finger levers thus to open or close the respective escrow doors which they control. Mounted on each escrow door lever is a door control wire 380 received in the slot 191 of each door. The control wire includes a leg 380*a* which passes through the body 370*a* of the escrow door lever and is locked in a notch 375*a*. The other leg 380*b* is locked in a notch 386 of a tab 387 which extends in the same direction as the lever arm. Thus, as the escrow levers are rotated, the door control wire moves in an arc to effect rotation of the associated escrow door.

Figure 21:
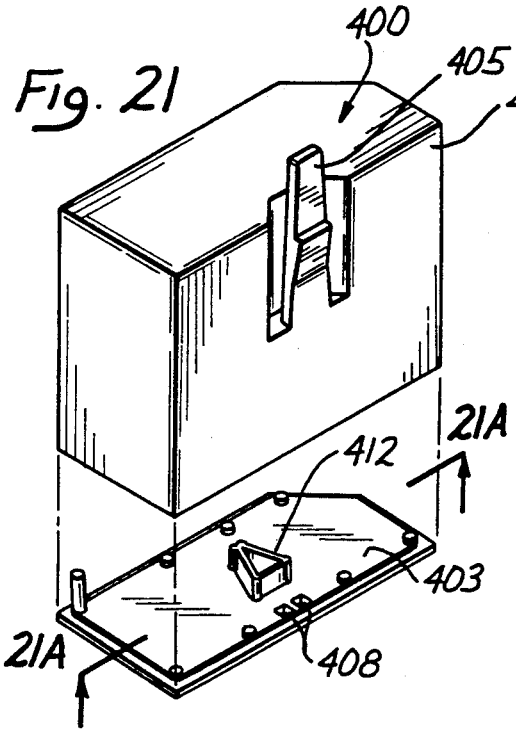
FIG. 21 is a developed view, in perspective, of the battery cartridge.
Figure 21A:
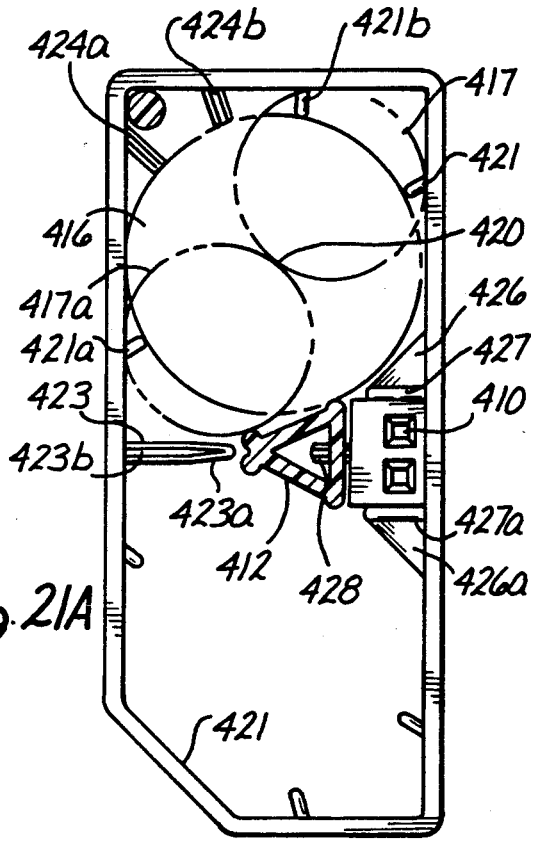
FIG. 21A is a sectional view, looking down into the battery cartridge housing.

On of the unique features of this invention is the battery unit 38 illustrated in FIG. 2 and whose details are illustrated in FIGS. 21 and 21A. The housing 400 is basically of two pieces, the housing chamber 402 and the base 403, the latter sonically welded to the chamber after the batteries have been assembled in the chamber. The chamber outer wall includes a pivoted mounting finger 405 which is received in an aperture 405*a* in plate 35 (see FIG. 2) to lock the battery unit in place. The under side of the base which faces the housing chamber includes apertures 408 through which male prongs from the control board 30 extend to make connection with the female receptacles of the battery connector 410, the latter being connected by leads to each of the batteries. The under side also includes a generally triangular locater 412 whose function is to hold the connector and the batteries in place at the battery connector end of the housing.

The interior of the battery housing is configured uniquely to accommodate 4⅔ Amp 3 volt cells (2 pairs of 2), 2⅔ Amp 3 volt cells or 2 C cells of 3 volts. Since the length of the 2⅔ pair cell is less than that of the 2 C cells and the diameters are different, a series of baffles is provided interiorly of the housing and of different axial lengths to hold the different combinations mentioned. As seen in FIG. 21A, only half of the arrangement of cells is illustrated. The cell 416 longer and larger is diameter while the two ⅔ Amp cell pair is 417*a* and 471*b* is shorter but of a larger combined diameter. The combined diameter of 417*a* and 417*b* is greater than that of 416, however, the baffles are oriented with a common center axis 420 and are arranged essentially radially with respect to that axis.

As seen in FIG. 21A, save for the inclined wall 421, the battery housing is essentially symmetrical with respect to the internal baffling. The inclined wall is used solely for orientation alignment purposes thus preventing the battery pack from being incorrectly inserted with possible damage to the male connecting pins of the control board. The bracket 36 (see FIG. 2) is correspondingly contoured so that the batter pack will fit only in one orientation. The baffles include three short baffles 421*a*, *b* and *c* which offer seats for the shorter cell, since the latter rest on the tops of these baffles, and positioning guides for the longer cells since the radially inner surfaces contact the outer surface of the longer cells. Baffle 423 is a combined baffle, having a short inner section 423*a* which extends inwardly and a full length section 423*b* which does not extend inwardly as far as 423*a*.

Baffles 424*a* and 424*b* are full length baffles which contact only the larger diameter cells 416. In addition there are two short triangular baffles 426*a* and 426*b* which span the length of the base and terminate in two spaced walls 427*a* and 427*b* which extend to base 403. Between the walls 427*a* and 427*b* is another wall baffle 428 which includes an upward finger to bear against the back side of the connector housing.

Figure 22:
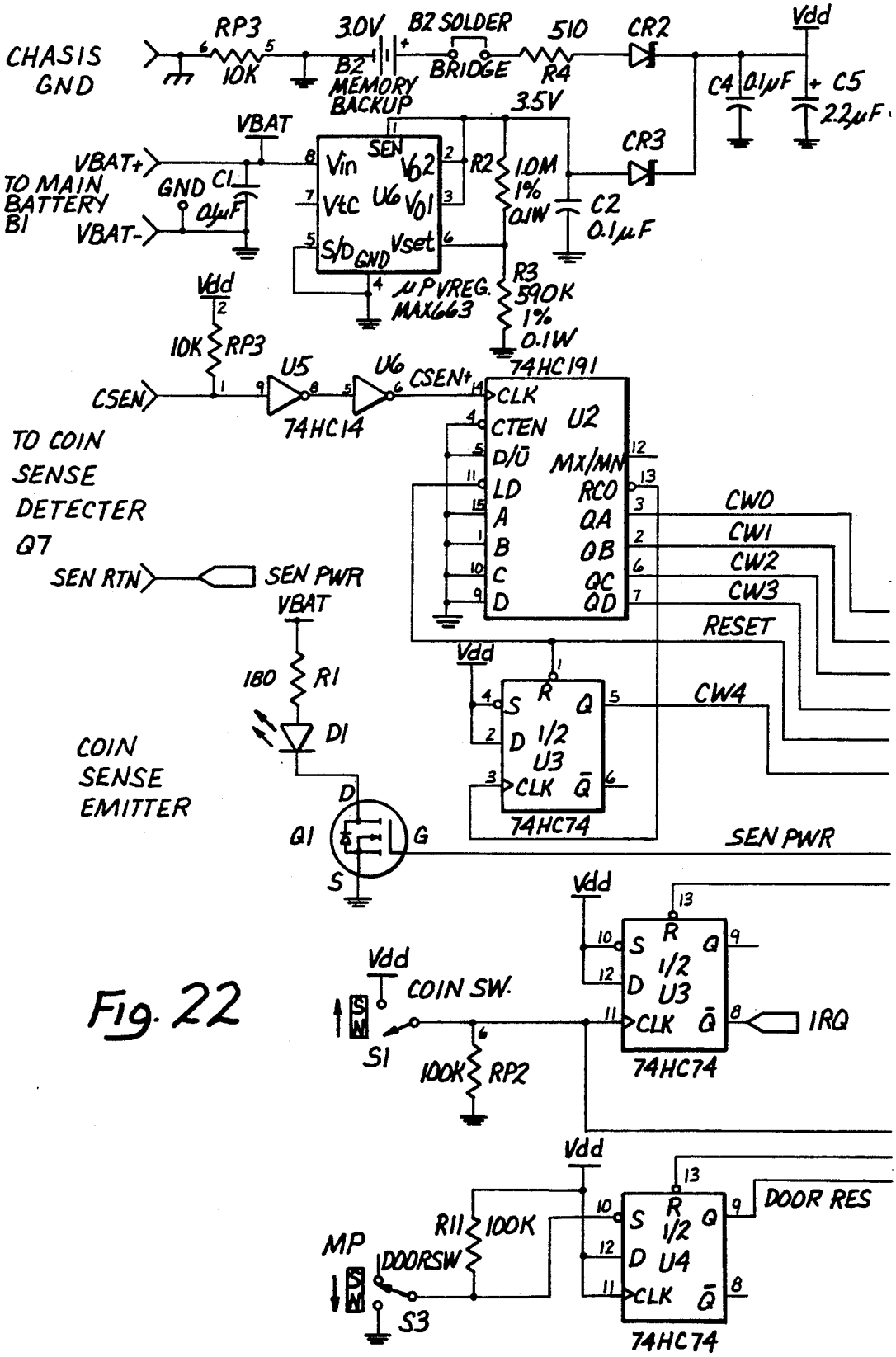
FIG. 22 is a schematic of the electronic control board.
Figure 22:
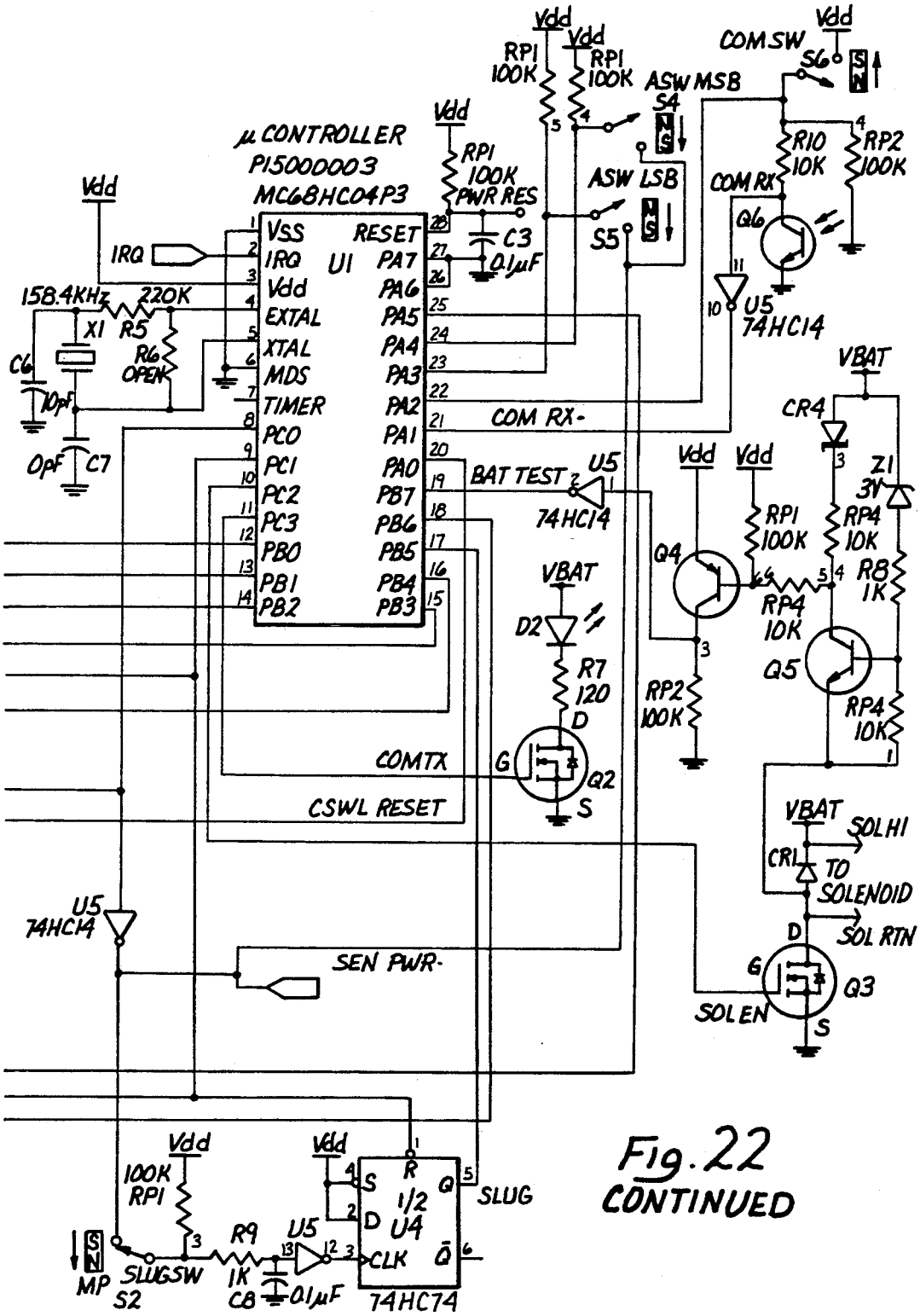

FIG. 22 is a schematic diagram of the circuit of the electronic circuit board in which the designation used on the circuit diagram will be used.

Figure 23:
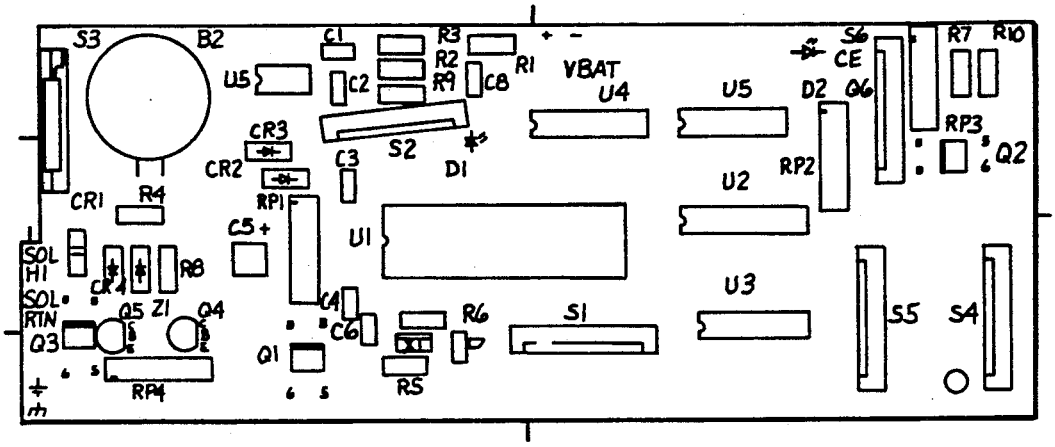
FIG. 23 is a view of the component placement on the electronic control board.

FIG. 23 is a view of the actual placement of components on the control board 30 since the latter are placed is a predetermined position for cooperative interaction with various components of the coin mechanism.

Referring now to FIGS. 22 and 23, the illustrated circuit was designed with four major constraints: (1) It must operate on battery power, therefore the circuitry must be low in power consumption to extend battery life; (2) It must operate in temperature ranges from −40 to 140 degrees F.; (3) It must be unaffected by environmental conditions such as humidity and salty air; and (4) It must be simple and reliable. The circuit illustrated, along with the proper packaging, also illustrated, meets all of these criteria. Virtually all of the circuitry uses the MOS family of logic since it features extremely low power consumption, a wide range of operating voltage, and can operate over the necessary temperature range. The circuit is always powered. Ideally it would be desirable to operate the entire circuit in a static "sleep" mode, because in this mode static MOS circuitry draws nano to microamps of current. That is the basic approach to this circuit design. Every active component is configured in a high impedance state allowing only leakage currents to flow. Only when a function becomes active, does its circuitry change to draw a small pulse of current for the minimum time necessary to accurately process the function then return to the static "sleep" state. The only exception to this is the clock circuitry of the micro-computer U1, which continually runs at a slow speed to keep track of relative time, as contrast to chronological time. Unlike other designs, there is only one clock and one clock frequency, and there is no need to switch clock frequencies for different functions. The clock circuit runs at an order of magnitude slower than other designs, and therefore draws much less power (power consumption is directly proportional to clock speed), without compromising performance.

The heart and brains of the circuitry is a micro-computer on a chip U1. This integrated circuit (IC) contains a central processing unit (CPU), program read only memory (ROM), random access memory (RAM), a timekeeping clock circuit and input/output control ports. U1 manages all of the reader preset information, as well as recorded sales information in its on board RAM. The clock circuit keeps track of relative time (relative to the reader real time clock), and is used as the timing source for the circuits serial communications. All of the processed sensor signals such as Coin Wheel Switch, Slug Detector Switch, Coin Word, Price Selection Switches, Door Reset Switch, Communications Sense Switch, and Battery Test Circuit are read into U1 RAM via the input ports. U1's output control lines activate the Coin Sense Emitter and Sensor Power Lines, control the latch and counter reset functions, enable the solenoid which sets the mechanical latch to open the dispensing or access door, and control the serial communications transmit line.

There are basically two types of sensors used in the circuitry and associated components, optical and magnetic. Movement of the magnet in the coin wheel is detected by S1. Slug detector switch S2 is held closed by a magnet in the coin sense housing. If a slug passes by in the coin wheel, the magnetic field is momentarily broken and sensed by S2. S3 senses a magnet whose position corresponds to the door rest function S4 and S5 sense a magnet(s) on the key quick change wire to allow up to four key selections of price. The price of each selection can be any price from 1 cent to $655.36 in increments of 1 cent. S6 senses the proximity of the magnet in the reader head and enable communication power. This signal specially processed by the software program in U1, so that a constant magnetic field will not hang up the system in the communications mode.

D1 is an infrared optical emitter which provides the single light source needed to perform the coin reading operation. Q7 is the single photo-transistor needed to read the coin pulses which identify the coin. D2 is an infrared optical emitter which provides the serial communications light source, and Q6 is the photo-transistor for receiving serial communications. The schematic shows the sensors in their static positions. In these positions, all of the sensors are in a high impedance state and draw only leakage currents.

U3 and U4 are electronic latches which grab and hold the change of state of the sensor switches such as the Coin Wheel Switch and the Slug Detector Switch. They hold the data until U1 has had a chance to examine and process it, then clear these latches. This circuitry would not be necessary if power consumption were not a material consideration. In that case, the clock speed of U1 could be increased and the state of the sensors could be sampled at a fast rate, thereby eliminating the need for U3 and U4.

U5 is a Hex Schmitt Trigger Inverter used to provide the proper phase signal to circuit components. In addition, it "squares up" slower changing, transition edges of signals such as the serial coin pulses so that they can be accurately processed by the counter circuitry. U2 and ½ of U3 create a counter circuit which converts the serial coin pulse data to a parallel coin word. Again, this circuitry would be unnecessary if power consumption were not a factor. In that case, the clock speed of U1 could be increased so that the coin detector could be sampled at a fast rate, and thereby translated by software into a coin word.

Battery B1 is the primary battery source. However as seen in FIG. 23, there is a battery B2 which us used to provide sufficient power to retain stored information in the electronics when the main battery B1 is changed or removed. The main power line VBAT is the direct output of this battery which powers the entire circuit. There is also a back-up battery B2. B1 is the only source, however, that powers voltage regulator U6, the coin sense emitter circuit (R1, D1, and Q1), the serial transmit emitter circuit (R7, D2, and Q2), the battery test circuit (R8, RP4, CR4, Z1 Q5), and the door latching solenoid circuit (Q3 and CR1). All of these circuits draw considerably more power when activated than the rest of the circuitry. The CR2, CR3 rectifier circuit is designed so that whenever the primary battery B1 is removed, B2 (which is a much smaller capacity battery), holds up all of the clock and memory circuits, but cannot be drained by the higher power circuitry. In this way, when the primary battery is removed, sales of papers or other items and optical communication is disabled, but all previous information and status (including sales price) is maintained via B2. When B1 is replaced, the sales and communication functions pick up where they left off with no system rebooting necessary. In other designs, rebooting is necessary.

The crystal clock oscillator circuit (U1, R5, R6, C6, C7 and X1) has a major contribution toward the circuit's steady state power consumption. This circuit's power consumption is proportional to the capacitance it must charge, the voltage swing due to the supply voltage of Vdd, and the frequency of operation. In accordance with this invention, the approach to reducing this circuit's power consumption is to reduce the stray capacitance in the circuit board design, operating at as low of a frequency as is possible (158.4 KHz, for example), and reducing the Vdd supply voltage to as low as possible. The typical B1 voltage is 6 volts and B2 is 3 volts. Thus, Vdd should be kept above 3 volts to prohibit B2 from unnecessarily conducting current, and to provide enough voltage drive to the Field Effect Transistors (FETs) Q1–Q3. Therefore Vdd was selected in the range of 3.2 to 3.5 volts. This was achieved by using U6 which converts VBAT to this level of Vdd. The Vdd voltage may be changed if desired by resistors R2 and R3. The U6 high impedance circuit adds a few microamps, but the reduction in oscillator power reduced the total circuit's steady-state consumption from over 1,000 microamps to typically 67 microamps.

For electronically switching higher current devices such as optical emitters and the solenoid, power FETs Q1–Q3 are used. These devices have extremely high input impedances and therefore draw very little input current. They act very much like an ideal switch, having very high off resistance and very low on resistance.

The battery test circuit is unique in that it draws only leakage current in its normal off state. In this state Q3 is turned off allowing no current to flow through Q5, and Q4's base is held high keeping it in the off state and producing close to zero volts at the collector. Every time the solenoid is fired by a pulse at the gate of Q3, the drain of Q3 pulls Q5's emitter low enabling current to flow. This also allows the battery test to be performed under maximum load. The zener diode Z1 and resistor R8 set the test voltage. During the time that Q3 goes low, if VBAT is high enough, the current in the base of Q5 will force its collector low causing Q4's collector to got high. This indicates a "pass" for B1. If VBAT is lower than the solenoid, however, there will not be enough current in the base of Q5 to force its collector low, so it remains high causing Q4's collector to remain low. This indicates a "fail" for B1.

Figure 24:
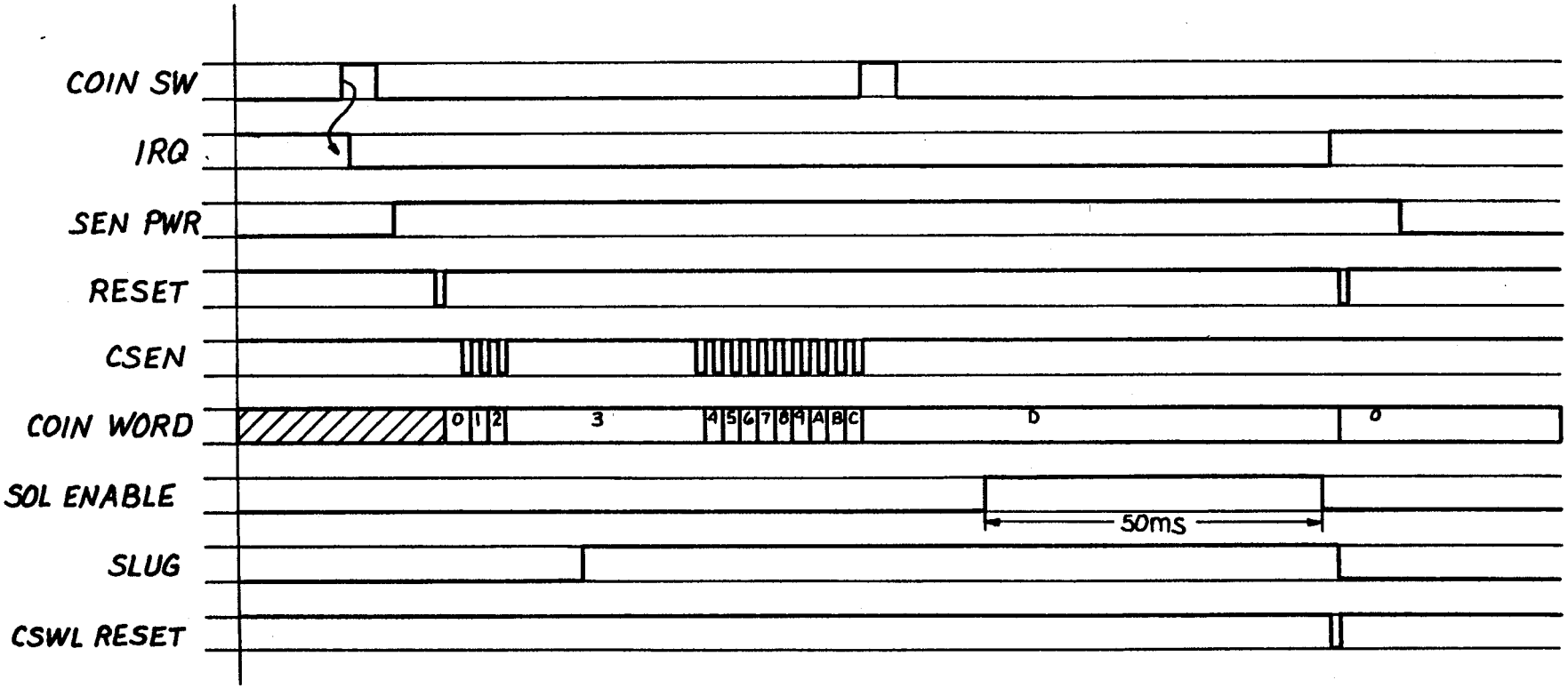
FIG. 24 is a timing diagram for the various functions.

When the circuit is first powered, or when the RESET line of U1 (pin 28) is connected to ground, the micro-computer U1 goes to a reset state. Certain RAM locations such as newsstand amount, timer and control flags are zeroed. In order to proceed through initialization, a special software state (solenoid return line shorted to ground enabling battery test circuit [indicating "pass"], must be detected). Upon detection, the micro-computer then polls the serial communications receive line (U1, pin 21) until a "hello" password is received. If received, the micro-computer transmits an "acknowledge" command. Then it receives the "back door" password (the highest authority password), and the following timing parameters: (1) T1—Delay after sensor power before read of coin word; (2) T2, T3—Coin wheel timeout value (maximum time for coin wheel to produce a coin word); and (3) T4,T5—Solenoid firing time. The last byte received is the power up sum check. The timing sequence is illustrated in FIG. 24 and the routine is set out in FIG. 25.

Figure 25:
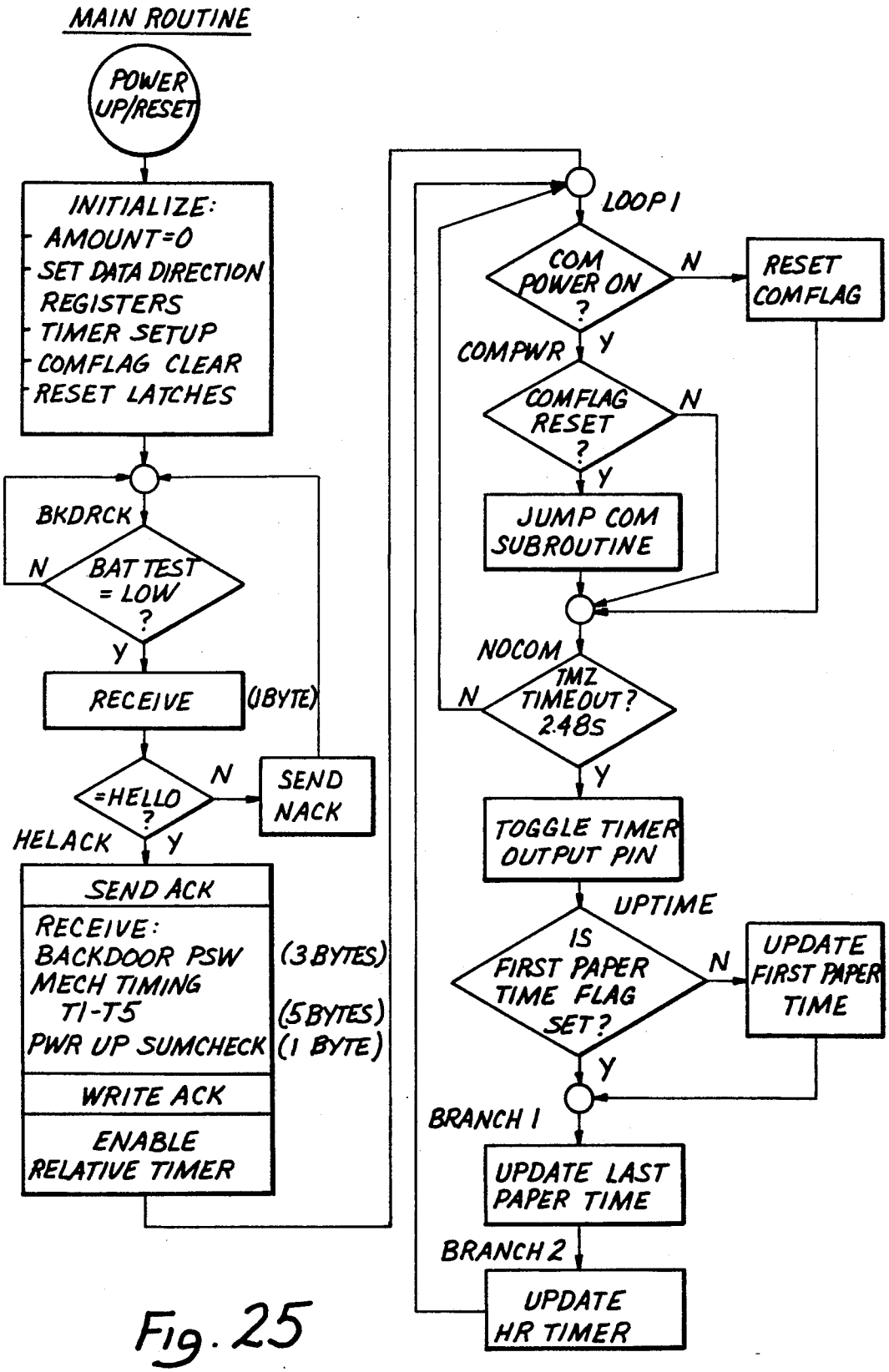
FIG. 25 is a logic and flow diagram of the main routine.

Once the initialization has been received, the micro-computer goes into its main loop, see FIG. 25, which consists of communications detection and time keeping. The various routines are illustrated in FIGS. 26 to 29 and reference is made thereto.

To avoid interpretation of spurious light sources as valid data, communications with the reader requires detection of a closure of S6 by U1 pin 22 due to the proximity of the reader head piece magnet. The micro-computer's software will only initiate communications with a transition of S6 from open to closed. This also prevents a constant magnetic field from "locking up" the micro-computer in the communications mode. The circuit's unique timekeeping design uses the relative timer in U1 to manage its timekeeping functions, thus eliminating the need for a real time clock. This is done to reduce parts counts, cost, and power consumption, and to eliminate the need for calibration of the clock due to changes in time (e.g., daylight to standard or variances in adjacent time zones), or drifting of clock crystal over time. The real time reference is managed by the reader.

There are three basic timekeeping functions of the circuit; first item sale time, last item sale time, and the number of sales per period (half or hour sales, for example). These counters are reset by the reader which records the absolute time of reset, and thus the reference time. The counters then begin counting from zero. When the first sale is made, the first sale counter is frozen and the last sale counter is reset to zero. For each additional sale, only the last sale counter is reset to zero. Upon subsequent communication with the reader, the first sale counter indicates the delta time from the previous communication to the first item sale, and the last item sale indicates the delta time from the last item sale to this communication. The items sold may, for example be papers. An item sold per period pointer is initialized by the previous communication and automatically increments when the period counter reaches a programmed value. The period counter is then reset to zero.

Figure 26:
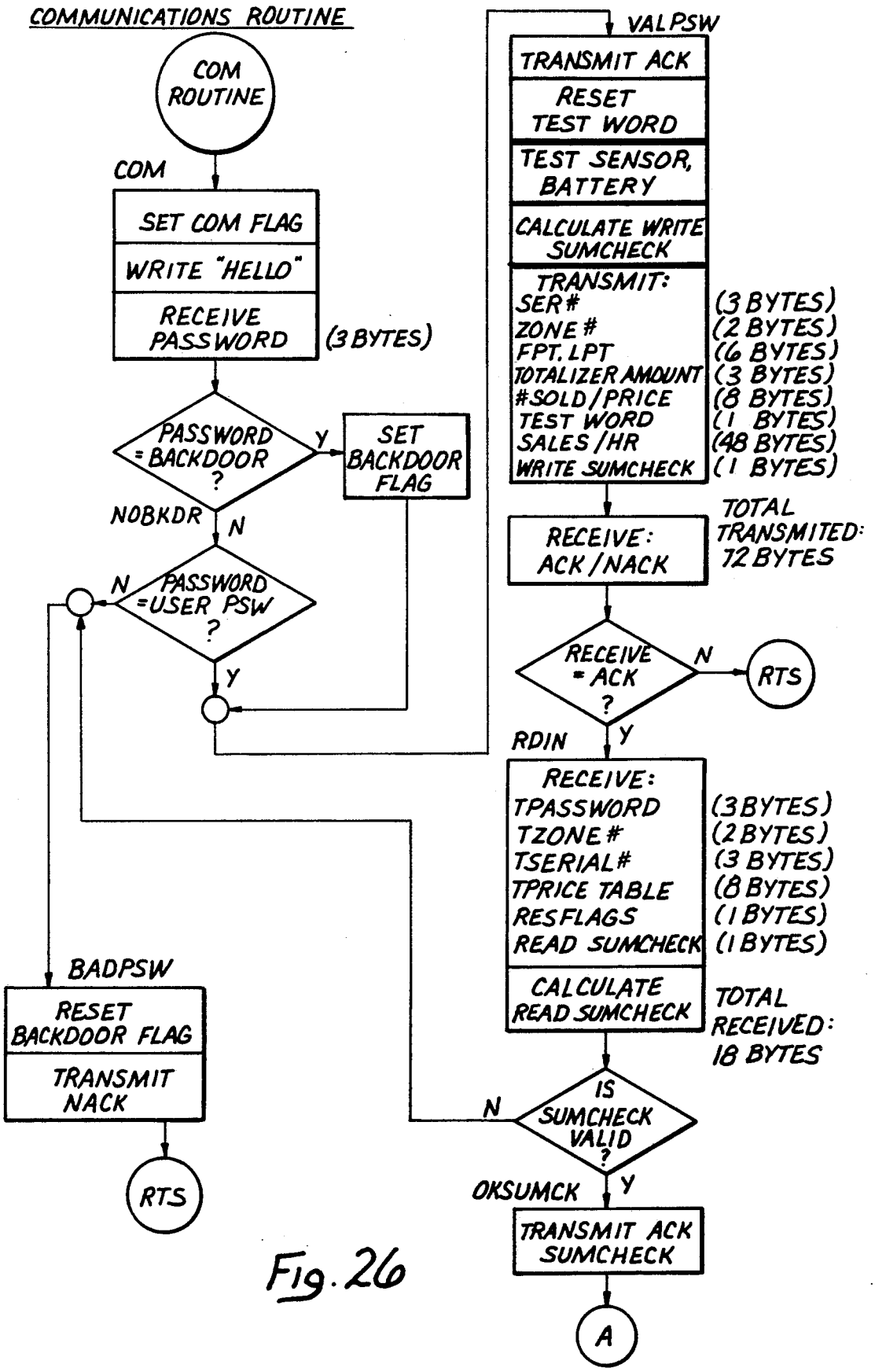
FIG. 26 is a logic and flow diagram of the communications routine.

Communications begins with a transition of S6 from open to closed; the routine illustrated in FIG. 26. A software flag (COMFLAG) is set to indicate the transition. The circuit transmits a "hello" to the reader and then waits to receive a password. If the password does not match the backdoor or user password within a prescribed period of time the circuit will transmit a negative acknowledge (NACK), abort communications, and return to the main loop. If a proper password is received, then an acknowledge (ACK) is transmitted. The the battery is tested under load, and the circuit transmits the following information is this sequence:

1) Mechanism serial number.
2) Zone assignment (identifiable location).
3) First and last item (paper) sale.
4) Totalizer amount.
5) Price buckets (number of items [papers] sold at each price.
6) Test word.
7) Number of items (papers) sold per period.
8) Write sum check.

The circuit then waits to receive an acknowledge. If the acknowledge is a NACK, it then aborts the communications and returns to the main loop. Otherwise, it prepares to receive the following programing commands: 1) New password; 2) New zone assignment; 3) New mechanism serial number (for service replacement); 4) New price configuration; 5) Configuration flags; and 6) Read sum check.

A sum check is calculated and compared against the read sum check. If they do not agree, the circuit transmits a negative acknowledge (NACK), aborts the communications and returns to the main loop. Otherwise, an acknowledge (ACK) is transmitted and the proper configuration changes are carried out. Based on the settings of the configuration flags, the following items may be changed:

1) Mechanism serial number.
2) User password (for security).
3) Zone assignment.
4) Reset amount totalizer and price buckets.
5) Price configuration.
6) Reset period; first item (paper) and last item (paper counters, sales per period counts.

This sequence completes the communications sequence with the reader.

When a coin is inserted into the coin mechanism, it falls into the coin chute, as described, and into the coin wheel. The weight of the coin causes the wheel to rotate and, as the wheel rotates, the coin wheel magnet triggers S1 which latches the output of U3 pin 8, the latter connected to the interrupt line (IRQ) of the micro-computer U , pin 2. This latched signal tells the micro-computer that wheel rotation has been sensed and that it should begin the coin recognition routine.

The coin sitting in the V-groove covers up a certain number of consecutive slots depending upon the coin diameter. A single beam of light is emitted on one side of the coin wheel and a single optical detector is directed toward the emitter on the opposite side of the coin wheel. As the coin and wheel rotate downward, each slot that remains uncovered by the coin allows a pulse of light to pass from the emitter to the detector. Thus, each coin creates a unique number of pulses at the detector (Q7) output depending on the coin diameter.

The larger the coin, the smaller the number of pulses. When the wheel completes its downward travel, the coin falls into the escrow. Then the wheel rotates upward and pulses of light are passed from the emitter to the detector for all slots. Pulses from the detector are counted by the U2 and U3 counter circuit and the coin word output is fed to the micro-computer U1.

The validity of a coin is controlled and verified in several ways. (1) By increasing and/or decreasing the number and spacing of mechanical slots in the coin wheel, one can alter the number and type of coin denominations that can be recognized as well as the resolution needed to distinguish various coins. The software code which identifies the coin in the micro-computer U1 can easily be modified to accommodate changes in coin denomination and numerous currency systems. (2) Pulses are counted in both the downward and upward rotation of the coin wheel. For example, for a coin wheel with ten slots, U1's software will only recognize a coin where the pulse count is between 10 and 20, since anything less than 10 pulses would indicate that the wheel has not successfully rotated downward and then upward. This prevents interpretation of spurious movements of the wheel (due to mechanical shock or shaking of the mechanism) and foreign materials from being interpreted as a legitimate coin. (3) A software coin table in U1 defines all possible coin words and associates the appropriate or zero value to the corresponding coin word. (4) Coin wheel movement is also monitored to guarantee that the wheel rotates fully down and then up again. This is determined by continually sampling the state of S1 and comparing it to a software model. Also a timeout routine in U1's software gives the coin wheel a programmable maximum time to perform a read. If this time is exceeded, the read is disqualified. This prevents interpretation of spurious movements of the wheel, due to shock and vibration and the like, and foreign materials from being interpreted as a legitimate coin. (5) The slug detector circuit senses if the coin is of magnetically sensitive metallic content. U1's software can be programmed by the reader to ignore or recognize this detection. If slug detection is enabled, even slugs of the same diameter as legitimate (non-magnetically sensitive) coins will be given a value of zero.

When a legitimate coin has been read and accepted, the value of the coin is added to U1's AMOUNT register and the coin is held in escrow. This process repeats for each coin until the deposited amount equals or exceeds the selling price of the item, e.g., a newspaper. At any time before the sale amount is achieved, any items in the escrow may be returned by pulling on the door. In this instance, the items in the escrow will be rejected to the coin return and the AMOUNT will be reset to zero. When the AMOUNT equals or exceeds the sale price of the item, e.g., newspaper, U1 will issue the command to fire the solenoid, allowing the customer to open the door and take an item, or to dispense one item, or to permit some other operations sequence to begin, for example, washer or dryer operation.

Prior to entering the coin recognition routine, the sensors and emitters are in a high impedance (Off) state. The control line for sensor power is U1 pin 8. In the Off state, this signal (SEN PWR) is low. This disables the coin sense emitter (Q1, D1, R1), Coin sense detector (RP3, Q7), key quick change circuit (RP1, S4, S5), and slug detector (RP1, R9, C8, S2) circuits. Only device leakage currents are present. This produces the lowest possible power consumption possible.

As the wheel rotates, the coin wheel magnet triggers S1 which latches the output of U3 pin 8 which is connected to the interrupt line (IRQ) of the micro-computer U1 pin 2. The status of S1 is also monitored at U1 pin 25. The high impedance S1, RP2, U3 circuit draws a small amount of current only when the coin wheel magnet is in proximity and S1 closes. When this happens, U1 jumps out of the main loop and enters the coin recognition routine. First it checks the status of the door reset latch (U4 pin 9). If this latch is set then the AMOUNT is reset to zero.

If the customer pulls the door handle, for example, to recover items in escrow, the door reset function is executed. Before the function is executed, a reset magnet in the mechanism housing, in proximity to S3, holds S3 activated (high). Upon executing the function the mechanism housing opens, removing the reset mechanism from proximity to S3 and releases S3 to its deactivated (low) state. The high impedance S1, R11, U4 circuit draws a small amount of current only when reset magnet is not in proximity. The state of S3 is latched into U4 and the output (U4 pin 9) is fed to U1 pin 18.

Next the SEN PWR control line goes high. This enables the coin sense emitter, coin sense detector, key quick change and the slug detector circuits. A delay determined by the programmable parameter T1 allows the sensors to power up and stabilize. Then the RESET control U1 pin 9 clears the U2 and U3 counter, door reset and slug detector latch (U4) circuitry.

Figure 30:
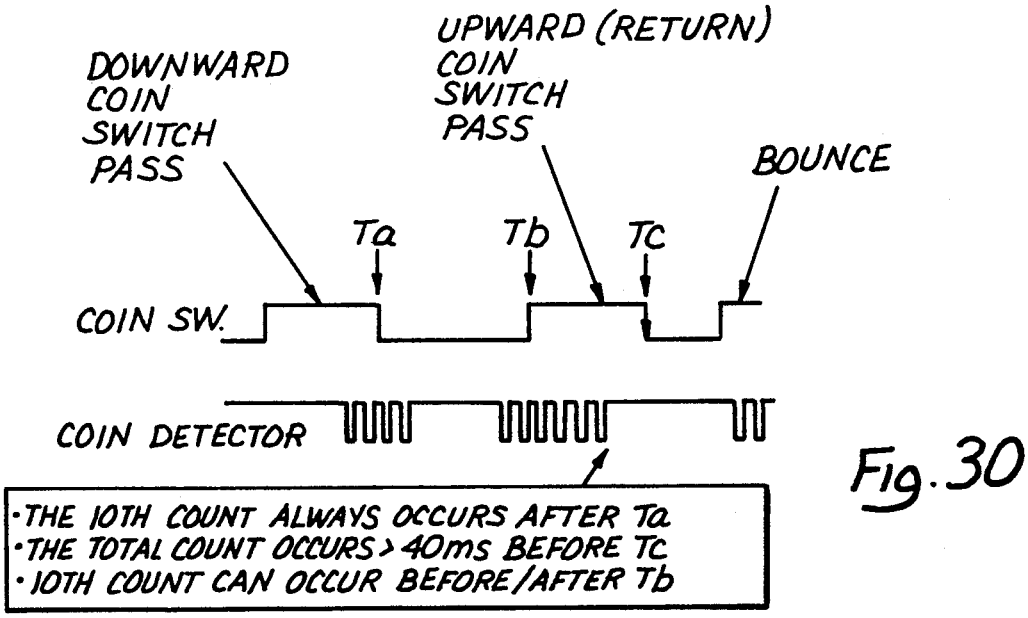
FIG. 30 is a timing diagram for the coin recognition sequence.

It is desirable to execute the coin recognition as fast as possible. A typical coin recognition cycle time should be much less than the coin wheel timeout. For this reason, U1's software is designed to recognize the correct number of pulses in conjunction with proper coin wheel operation (S1 pulse pattern), so that the coin word can be read at the earliest possible time for that coin. For example, a dime may take 0.6 seconds to complete its cycle, whereas a quarter may take 0.4 seconds. Rather than allow a fixed window of say, 0.7 seconds to read all coins, this approach will complete the cycle for a dime in 0.6 seconds and the quarter in 0.4 seconds. Furthermore, if the coin wheel were to speed up or slow down with time, this approach automatically tracks any deviations in coin wheel performance, up to the programmable coin wheel timeout value. This is accomplished by first resetting and starting a coin wheel timer. The coin word is sampled until it exceed half the maximum number of counts. After this occurs, the coin sense switch is sampled until it indicates that the wheel has completed its upward pass as indicated by time Tc in FIG. 30. If both of these criteria are not met prior to the prescribed coin wheel timeout, then the read is disqualified and the coin recognition routine is exited.

If the mechanism is programmed to reject slugs, then the following procedure, set forth in this paragraph, is executed, otherwise it is skipped. Located within the coin detector housing, as already described, is a magnet on one side of the coin wheel. This magnet creates a field which hold S2 in a closed position (low after SEN PWR is enabled). The high impedance S2, RP1, R9, C8 circuit draws a small amount of current only when SEN PWR enables this circuit. S2 will only open when a ferromagnetic object (e.g., slug) shunts the magnetic field. When this occurs, capacitor C8 is charged through RP1 and R9. This low pass filter rejects spurious noise and mechanical switch bounce that could erroneously set the slug latch (U4). The filtered signal is "squared up" with the Schmitt Trigger Inverter U5.

The output of the inverter feeds the clock input of the slug latch U4. The latched output SLUG of U4, which is connected to pin 17 of U1, goes high when a slug is detected. If a slug is detected then it proceeds to the coin recognition exit routine.

The next procedure is to read the coin word. The serial coin pulses from the coin sense detector circuit (Q7 RP3) are "squared up" with the Schmitt Trigger Inverters U5 (two being used to obtain the necessary polarity). The output of the inverter circuit is then fed to the clock input of U2 which combined with ½ of U3 creates a 5 bit counter circuit. The output of the counter circuit converts the serial coin pulses into a 5 bit parallel coin word which is fed to U1 pins 12–16. The coin word then provides an index to a coin value table from which is assigned a proper coin value or zero. This value is then added to the AMOUNT register and compared to the sales price set by the programmable price table and key quick change sensors S4 and S5. If the AMOUNT is less than the PRICE, then it proceeds to the coin recognition exit routine. If the AMOUNT is greater than or equal to the PRICE, a final check of the Door Reset latch is performed (if a reset is detected the Amount is reset to zero and it proceeds to the coin recognition exit routine), before firing the solenoid. If no reset is detected, the solenoid is fired for a time prescribed by programmable parameters T4 and T5. The solenoid is activated by enabling U1 pin 10 (SOL EN) high. This turns on FET Q3, grounding the SOL RTN line. Rectifier CR1 reduces the necessary on time by maintaining solenoid current flow after the SOL EN control returns low. The electronic pulse action on the solenoid set a mechanical latch, allowing a customer to open the door or dispensing the article or permitting use of the equipment, e.g., washer or dryer. The AMOUNT which is achieved by the sale is now added to the TOTALIZER (facilitating recording of the actual cash sum used to make the sale). Then the appropriate period for the number of articles or paper sold per period, and the prices sold at each price selection as indicated by the key quick change selection, are incremented by one. If this is the first sale, the first paper sale counter is frozen at its current value. The last paper counter and the AMOUNT are reset at zero. The last step is the exit routine which deactivates the SEN PWR and resets the latches.

Figure 31:
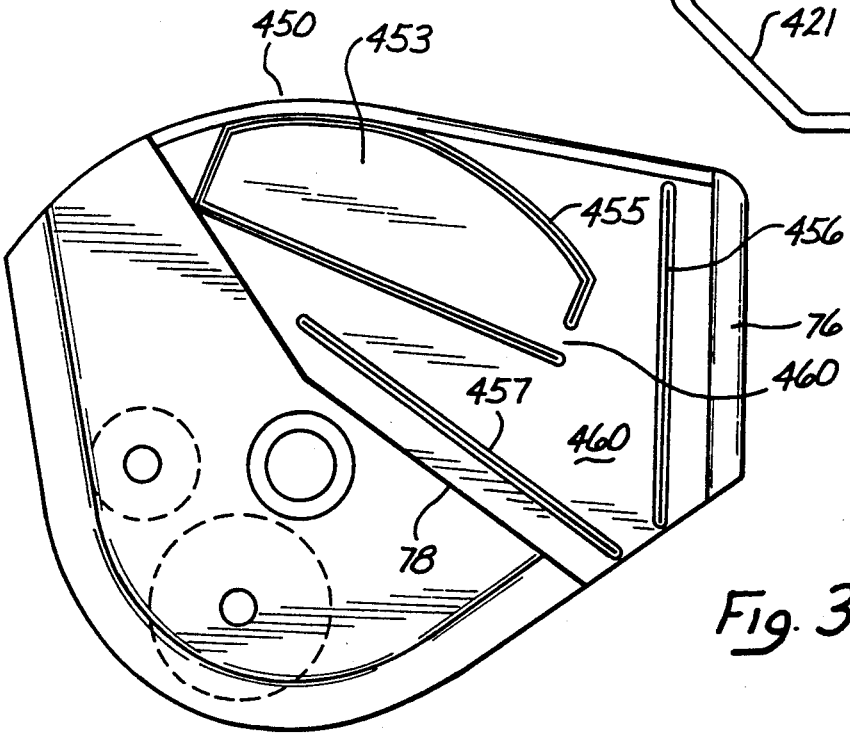
FIG. 31 is an enlarged plan view of an improved coin wheel.

In extensive experimental field tests under actual operating and environmental conditions, it was noted that the coin wheel was subject to less than perfect performance. One problem was the accumulation of dirt and moisture in the apertures or slots and the other problem was that in wet or high humidity conditions the face of the coin wheel against which the coins rest tended to hold the coins rater than to permit the same to release as the wheel rotated. In effect, the high surface tension of accumulated water acted as an adhesive to hold the coins on the wheel. FIG. 31 illustrates an improved coin wheel 450 similar to that previously described in FIG. 4 except that the slots (no shown) are covered with a clear plastic member 453 on each of the front and back side to prevent dirt and moisture from entering any of the slots. In these tests it was determine that even if water froze on the face of the covering, accurate coin reading was achieved. The problem seemingly was that water in the slots acted as a distorting lens.

The second improvement involves the use of a series of raised ridges 455, 456 and 457. In the aggregate, these ridges are located and configured to prevent any coin from contacting solely the flat surface 460 from which the ridges project. The configuration and location is such that the coins, regardless of diameter are held spaced from the flat surface and supported only by the ridges. In the form shown, one ridge 456 extends generally parallel but spaced from the shoulder 76. One ridge 457 is in spaced parallel relation to the shoulder portion 78. To prevent the coins from tipping and perhaps presenting an erroneous diameter to the coin sensor mechanism as the result of the tipping, the slots are essentially surrounded by ridge 455. However, this ridge 455 is not continuous but includes an open end 460 to permit water which might accumulate in the interior boundaries of ridge 455. The height of each ridge above the flat surface of the coin wheel is the same, again for the purpose of holding the coin in spaced flat relation to the flat surface. In all other material respects the coin wheel 450 is as already described.

Figure 27:
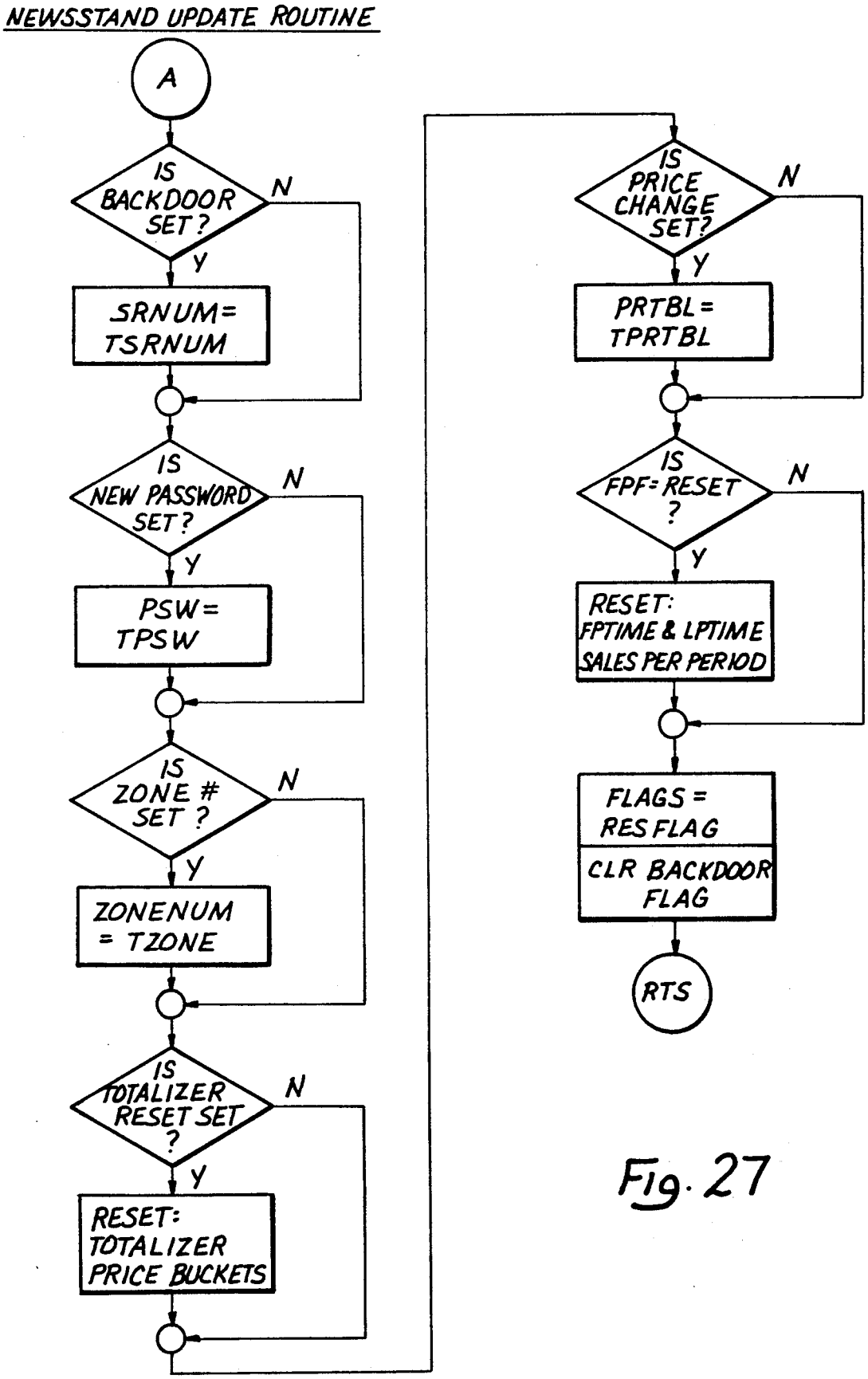
FIG. 27 is a logic and flow diagram of the newsstand update routine.
Figure 28:
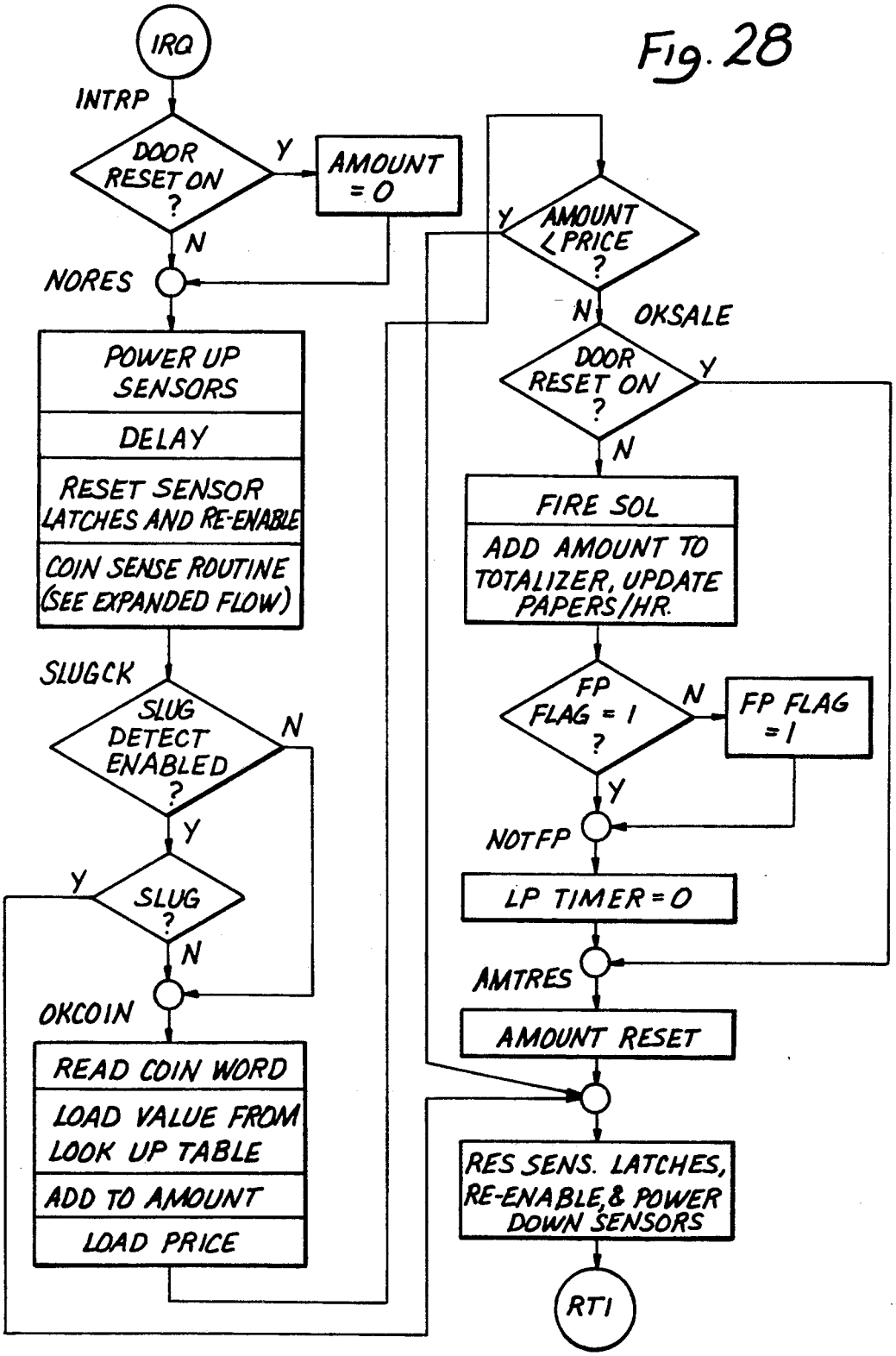
FIG. 28 is a logic and flow diagram for the coin recognition and sales routine.
Figure 29:
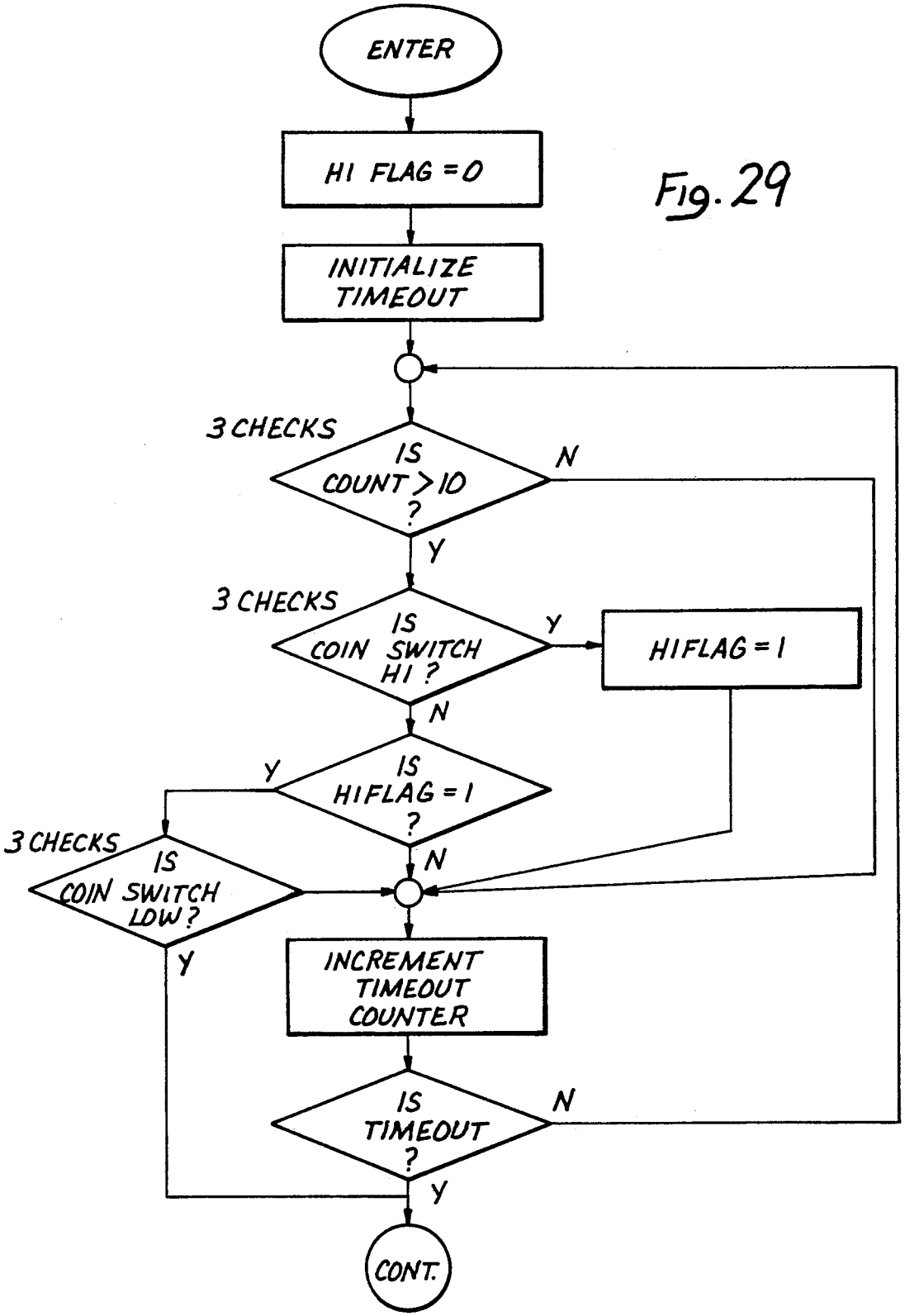
FIG. 29 is a logic and flow diagram for the coin sense/timing routine.

Based on the description thus far, it is now easier to understand the versatility, security and overall operation of the entire system. As noted previously, the total system basically includes an electronic coin mechanism, as described, a computer also described, a reader and a shuttle mechanism, also as described. The reader is a battery operated programmable unit containing an electronic circuit which may be programmed by the computer through the shuttle and is used to retrieve data from and to program the electronics of the electronic coin mechanism. For example, price changes may be made in increments of one cent; different prices may be set for daily, Sunday or other editions, the slug enable circuit may be controlled. It can also check the battery status and provide information as to the current prices set for that machine as well as whether the slug feature is enabled. As far as data from the electronics of the mechanism, the reader receives information regarding the number of units dispensed, first and last sale information and the time interval as well as the total amount of money received and more as seen in FIGS. 26 and 27. Communication between the reader and the electronic coin mechanism is optical, as described, the reader being provided with a locating finger F (FIG. 1) which is placed in the coin slot 21. The coin face plate includes an optically transparent window W to one side of the coin slot which is optically aligned with the optics of the reader when the reader is inserted.

Figure 32:
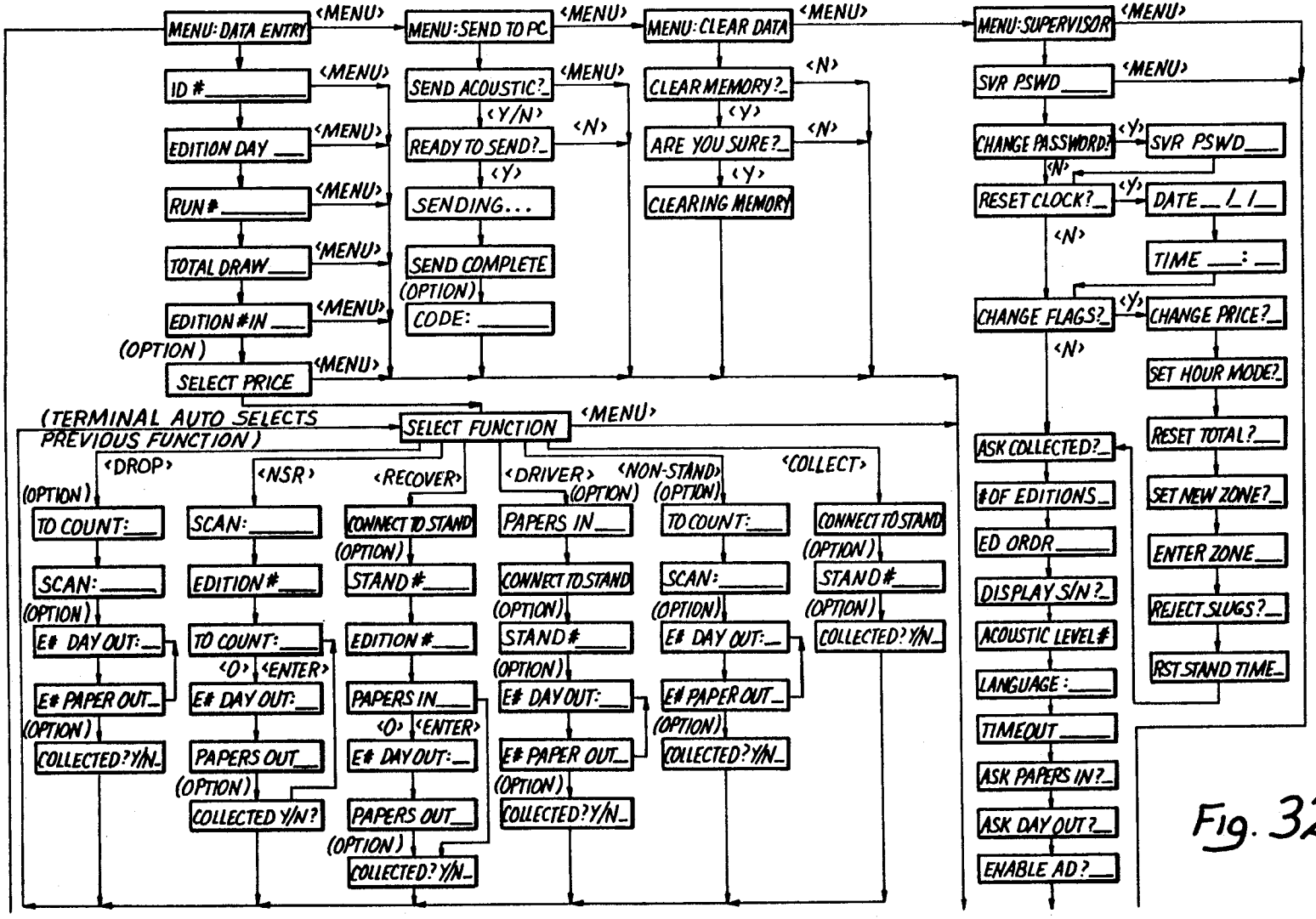
FIG. 32 is the reader program diagram illustrating the various functions of the reader unit in accordance with this invention.

The actual time of sales is calculated from the information recorded by the reader which records the time of service, the time interval, which are used by the computer to calculate actual time. In a preferred form the reader is also provided with an acoustic modem for transmission over standard telephone lines. FIG. 32 illustrates the program diagram for the reader and is basically self explanatory to those familiar with newspaper vending procedures.

The shuttle principally acts as an interface between the reader and the computer, the latter being programmed to receive and store various information and provide a wide variety of reports. The shuttle may optically read the information in the reader and may also include a modem for receipt of information over telephone lines from the reader and for transmission to the computer. For example, the electronics in the dispensing equipment stores an enormous amount of information as already described. This information may be read out and used to provide a wide variety of management reports through appropriate software in the computer. The shuttle also acts as an interface to program the reader by the computer which provides an efficient alternative to manual supervisor programming. The reader-shuttle and computer relationships also provide for a wide variety of security and programming configurations.

By the use of various levels of security codes, any tampering is prevented and erroneous or fabricated data may be easily detected. Thus, for example, each machine may be provided with a unique access code whose identity may be easily restricted. This is accomplished by the equipment maker providing a master code and a machine number code, which may not be altered other than by the manufacturer or under the control of the manufacturer. Based on this primary security level which is beyond the control of the machine user, it is impossible for stolen machines to be used in the normal intended operation by the thief. It is also impossible for others to access the data or to change or to read the data in any machine unless the primary codes are known. This provides an effective security protocol as between machine users in the same or different geographical areas. Typically, each reader has a user identification code which must be inputted by the user to permit use of the reader. That user ID code can be set by the computer and can only be changed by authorized personnel. The computer will store machine numbers, location, route and driver or other information. It will also keep track of which readers are issued to whom and how they are configured.

The second level of security is the company password which only the company knows and only which the company can access In the event that the company code is somehow discovered, it may be changed by the company.

Normally, irregularities are easily detected due to the variety of management reports that are provided. Typically, the company code determines the received information from the machine, the information sent to the machine such as slug detection enablement or price changes or totalizer functions. The company code also prevents one company from reading or making any alteration in the operating parameters of a competitor's machine. Route identification (zone numbers) prevents the reader from being used to access or service machines other than on the designated route.

The reader is principally an information access and transmission device and is used to determine from each machine various information electronically stored in the electronics and to record various information such as number of units retrieved, loaded and information related to machine location and sales information in terms of time interval rather than chronological time. The reader permits reading and storing of that information and transmission of that information to the processing computer. The reader permits access to the interior of the machine but not the locked coin box. The reader cannot reprogram the machines except in the case of price changes from daily to Sunday or the like or total price changes, provided the reader is authorized to do so by management control. This can be achieved by management reprogramming of the reader, a function that cannot be accomplished without access to internal codes programmed into the computer and thereafter programmed into the reader by management.

Still another level of security is that of zone control. This feature only allows the reader to access those machines in a defined geographical location or route. If an attempt is made to access information from a machine other than in a defined region, the result is a null reading. In this way, collection of data in zones other than those which can be accessed by the reader are precluded.

Typically, the person loading or retrieving is different from the person collecting funds. The cross-check which is important is the data from the loader-unloader and that from the collector. While papers may be taken without payment, this shows up in the loader-unloader report. If the collector report is at odds with the loader-unloader report, then this is easily determine by the management reports.

In a typical sequence, management provides to the computer a variety of information including equipment location, serial number, type of location, e.g., hotel, carry out or any other selected designation. The reader identification and the route operator name and address is also inputted. Optionally, the languages spoken by the operator may be inputted. In the case of leased machines, the lessee's name and address for billing purposes may be recorded. The route and machines on that route may also be determined by the computer software as well as the route driver. Where collection is different from servicing, that may also be inputted to control the allowable functions of the reader.

At the start of a route, the driver enters his or her location code in the reader. If there is one or more editions, then the edition being serviced is entered. The run or route number is then entered as well as the total draw of papers. Price change information may be entered if authorized by the supervisor. As the driver reaches an authorized machine the reader is inserted into the machine, the coin slot being used to align the optics. When the reader's proximity magnet is close to the machine, the reader then communicates with the machine to receive a electronic "hello". If there is no "hello", or the proper password is not achieved the sequence is aborted, see the logic and flow diagrams. If recognized, the machine can be opened and serviced including returns collected and items loaded as well as the time and date of service; sales information and time of sales is also downloaded and the status of the various settings such as price and slug detection. As each machine is serviced, the driver moves to the next machine. At the end of the route, information in the reader can be transmitted by modem or by returning to the facility which has the shuttle. In the case of separate collection procedures, the routine is basically the same.

It is apparent that with the versatility of the system, based principally upon the recognition of the coins and the relative time of coin deposit as well as the security which the system offers that meaningful management reports may be provided. From these data, management may determine the location of productive equipment, the need to increase or decrease items loaded to reduce returns, the need to increase or decrease route service, the geographical areas not covered be available equipment. For street sales and over the counter sales, the latter also monitorable by this system, there is provided a powerful tool for what has been traditionally a newspaper boys program. However, street sales are a significant part of the revenue of newspaper sales. The present invention provides a comprehensive system for updating and improving such sales.

It will be apparent from the foregoing that variations and changes may be made in the system and components described without departing from the present invention as set forth in the appended claims.

What is claimed is:

1. A coin operated mechanism for counting coins of various values to determine the value of a coin deposited comprising:

a coin wheel normally oriented in a coin receiving position and rotatable about an axis of rotation to a coin release position, said coin wheel including a coin receiving section, means to guide deposited coins to said coin wheel and to said coin receiving section whereby said coin wheel is rotated from said coin receiving to the coin releasing position by the weight of the coin, said coin wheel including a plurality of apertures located in a predetermined array, light source means on one side of said wheel and positioned to pass light through said apertures as said coin wheel is rotated, light detector means positioned on the side of said wheel opposite said light source and adapted to be illuminated by light passing through said apertures to produce a series of light pulses as said coin wheel rotates, said plurality of apertures being in an array such that one or more of said apertures is covered by a coin depending upon the diameter dimension of a coin; and electronic means to determine the value of each deposited coin.

2. A coin operated mechanism as set forth in claim 1, wherein said electronic means includes means to store reference numbers representative of the number of pulses representing the value of each of a series of coins of different values, said coin wheel and said light source and said light detector means being operative to count pulses as said wheel rotates from the coin receiving position to said coin release position and from said coin release position to said coin receiving position to produce a pulse value representative of the value of a coin, said electronic means further including means to compare said pulse value with said stored reference number to determine the value of said coin of a valid coin or to reject said pulse value as being a value other than valid coin, and said electronic means also including means to total the value of the valid coins passing through said coin wheel.

3. A coin operated mechanism as set forth in claim 1 further including battery means for powering said coin operated mechanism.

4. A coin operated mechanism as set forth in claim 1 wherein said mechanism is operative to respond to a combination of coins representing a predetermined price, and further including means to reject all of the coins deposited in the event that the total amount of deposited coins is less than the price.

5. A coin operated mechanism as set forth in claim 1 wherein said light source includes a single light source and said light detector means includes a single light detector.

6. A coin operated mechanism as set forth in claim 1 wherein said means to guide deposited coins is a coin chute, said coin chute being adapted to open fully in the event that less than the proper amount of coins is detected.

7. A coin operated mechanism as set forth in claim 1 further including an escrow unit to receive coins or other items from said coin wheel, and said escrow unit being adapted to direct the coins is one or another direction.

8. A coin operated mechanism as set forth in claim 7 wherein said mechanism includes a bank for receiving the proper amount of deposited coins and a coin return for returning coils to the user as controlled by said escrow unit.

9. A coin operated mechanism as set forth in claim 1 wherein said coin operated mechanism is installed in a newspaper dispensing rack having a door movable from a closed position to an open position to permit access to the interior of said rack, means operative in response to said coin operated electronic mechanism to permit said door to be opened.

10. A coin operated mechanism as set forth in claim 9 wherein said means operative to said coin operative electronic means includes lever means and a door latch mechanism, means to effect movement of said lever means to one position allowing said door latch mechanism to move to a door releasing position in response to deposit of the correct amount of coinage.

11. A coin operated mechanism as set forth in claim 3 wherein said battery means is a replaceable battery cartridge containing a battery element, said battery cartridge including internal baffle means to support batteries of different diameters, and said battery cartridge including means to make an electrical interconnection to power said coin operated mechanism.

12. A coin operated mechanism as set forth in claim 11 further including back up battery means to power said coin operated mechanism during change of said battery cartridge.

13. A coin operated mechanism as set forth in claim 1 wherein said coin wheel includes means to prevent dirt and moisture from accumulating is said plurality of apertures.

14. A coin operated mechanism as set forth in claim 1 wherein said coin wheel includes means to energize said electronic means during initial rotation of said coin wheel in response a coin being received on said coin receiving section.

15. A coin operated mechanism as set forth in claim 1 wherein said electronic means further includes means to store the total amount of coins.

16. A coin operated mechanism as set forth in claim 2 wherein said electronic means includes clock means for determining elapsed time, and means to store the elapsed time between each sale.

17. A coin operated mechanism as set forth in claim 1 wherein said coin wheel includes means from prevent coins from sticking to said coins wheel.

18. A coin operated mechanism as set forth in claim 1 further including means to inhibit bouncing of said coin wheel during rotation thereof.

19. An integrated electronic system for coin operated vending equipment comprising:

at least one battery powered coin operated dispensing machine, said machine including electronic means for recognizing the value of each coin deposited and being operative to permit operation of the machine to dispense a product, said electronic means including a rotatable coin wheel having a predetermined number of apertures from which the diameter of a coin may be determined light source and detector means positioned on each side of said coin wheel for counting pulses produced by light passing through said apertures as said wheel rotates, said electronic means being operative to store predetermined information including one or more prices for the product being dispensed, the relative time of the first and last sale, the relative time of each sale and the total amount of money received by said machine for dispensing a product, reader means for retrieving information stored in said electronic means and for programming said electronic means for certain functions, computer means, shuttle means for interfacing said reader and said computer whereby data retrieved from dispensing means may be processed, said electronic means including a secure code to identify the machine, and said reader including a secure code inputted by the user to activate the same.

20. An integrated electronic system as set forth in claim 19 wherein said light source and detector is a single light source and detector.

21. An integrated electronic system as set forth in claim 19 further including means for changing the price other than by the reader.

22. An integrated electronic system as set forth in claim 19 wherein said coin wheel includes means to prevent dirt and moisture from entering said apertures.

23. An integrated electronic system as set forth in claim 19 wherein the data stored in said reader is read into said computer by said shuttle.

24. An integrated electronic system as set forth in claim 19 wherein said system includes a plurality of battery powered coin operated dispensing machines, said reader means including a plurality or reader units, some of said reader units being programmed to read information from only some of said coin operated dispensing machines.

25. An integrated electronic system as set forth in claim 19 wherein said reader means includes acoustic modem means for transmitting information over telephone lines.

26. An integrated electronic system as set forth in claim 19 wherein said reader means includes optical means for retrieving data from said electronic means.

27. An integrated electronic system as set forth in claim 19 wherein said shuttle includes optical means for receiving data from said reader means.

28. An integrated electronic system as set forth in claim 19 wherein said reader includes a real time clock, said reader being operative to convert relative time input from said electronic means to time of day data.

29. An integrated electronic system as set forth in claim 19 wherein said electronic means includes means to disable access to coin operated dispensing means if less than the proper coinage is deposited therein, and said dispensing means including means to return less than the proper coinage if less than the proper coinage is deposited.

30. An integrated electronic system as set forth in claim 19 wherein the data read by said reader means is raw data stored in said electronic means.

31. An integrated electronic system as set forth in claim 19 wherein said computer includes access codes limiting the programming of said reader in the absence of knowledge of said access codes.

* * * * *